US006534228B2

(12) United States Patent
Kawada et al.

(10) Patent No.: US 6,534,228 B2
(45) Date of Patent: Mar. 18, 2003

(54) ELECTROPHOTOGRAPHIC PHOTOSENSITIVE MEMBER AND IMAGE FORMING APPARATUS

(75) Inventors: Masaya Kawada, Shizuoka (JP); Toshiyuki Ehara, Kanagawa (JP); Tetsuya Karaki, Shizuoka (JP); Hironori Ohwaki, Shizuoka (JP); Kunimasa Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/859,422

(22) Filed: May 18, 2001

(65) Prior Publication Data

US 2002/0037464 A1 Mar. 28, 2002

(30) Foreign Application Priority Data

May 23, 2000 (JP) ..... 2000-151699
May 18, 2000 (JP) ..... 2000-146527

(51) Int. Cl.[7] ..... G03G 5/147
(52) U.S. Cl. ..... 430/66; 399/159; 399/359
(58) Field of Search ..... 430/66; 399/159, 399/359

(56) References Cited

U.S. PATENT DOCUMENTS 5,381,211 A * 1/1995 Godlove ..... 430/127
5,761,594 A * 6/1998 Seto et al. ..... 399/302
6,020,098 A * 2/2000 Bretscher et al. ..... 430/66
6,128,456 A 10/2000 Chigono et al. ..... 399/176

FOREIGN PATENT DOCUMENTS

| | | |
|---|---|---|
| JP | 6-118741 | 4/1994 |
| JP | 8-129266 | 5/1996 |
| JP | 9-204056 | 8/1997 |
| JP | 9-297420 | 11/1997 |
| JP | 10-307455 | 9/1998 |
| JP | 10-333350 | 12/1998 |

OTHER PUBLICATIONS

U. S. patent application Ser. No. 09/819,759, Ehara et al. filed Mar. 29, 2001.

* cited by examiner

*Primary Examiner*—John Goodrow
(74) *Attorney, Agent, or Firm*—Fitzpatrick,Cella,Harper&Scinto

(57) ABSTRACT

To provide a Si photosensitive member and an image forming apparatus which prevents toner adherence at the time of cleaning and forms an excellent image, an electrophotographic photosensitive member comprising a photoconductive layer including amorphous Si and a surface protective layer which are formed on an electroconductive substrate has a difference in the height of concave and convex corresponding to 90% and 50% of a cumulative frequency of the height of concave and convex with respect to the most deepest point of surface roughness concave and convex within a range of 10 $\mu$m×10 $\mu$m of the photosensitive member as a standard which is set within a range of 3 nm to 200 nm.

13 Claims, 16 Drawing Sheets

(4 of 16 Drawing Sheet(s) Filed in Color)

KEIMA PATTERN

ELECTROPHOTOGRAPHIC PHOTOSENSITIVE MEMBER AND IMAGE FORMING APPARATUS

BACKGROUND OF THE INVENTION

1. Field of the Invention

The prevent invention relates to a photosensitive member formed by stacking in order a photoconductive layer containing amorphous Si and a surface protective layer, and to an image forming apparatus represented by an electrophotographic apparatus comprising the photosensitive member of the present invention.

2. Related Background Art

In the electrophotographic apparatus such as a copier, a facsimile, a printer or the like, an outer peripheral surface of the photosensitive member disposed with a photoconductive layer on its surface is uniformly charged by charging means such as corona charging, roller charging, fur brush charging, magnetic brush charging or the like and then the image of an object to be copied is exposed by laser or LED responding to a reflective light or a modulation signal, whereby an electrostatic latent image is formed on the outer peripheral surface of the above described photosensitive member. Further toner is adhered on the photosensitive member and then it is transferred to a copy paper or the like to complete copy.

After completing copy in this way by the electrophotographic apparatus, because toner remains on the outer peripheral surface of the photosensitive member, it is necessary to remove the remained toner. The removal of such remained toner is usually performed by a cleaning step using a cleaning blade, a fur brush, a magnetic brush or the like.

Also, in recent years, from the environmental concern, for the purpose of reducing or canceling waste toner, an electrophotographic apparatus omitting a cleaning equipment is proposed and disclosed. This system is a direct charger similar to a brush charger such as disclosed in Japanese Patent Application Laid-Open No. 6-118741 which serves as a cleaning step, or a developing device such as disclosed in Japanese Patent Application Laid-Open No. 10-307455 which serves as a cleaning step, or the like, but each system includes a step of rubbing the toner and the photosensitive member surface together to remove the toner.

Since the amorphous silicon photosensitive member has a large surface hardness and a small wear amount, a low resistance material contained in a charging product and a transfer paper is difficultly removed in the above described cleaning step from the photosensitive member, whereby the electrophotographic apparatus using the photosensitive member easily generates a high-humidity smearing, and efforts for preventing this has been still continued since from the past. Concretely, in order to remove a moisture content by heating with a heater, removal of a substance causing the smearing by rubbing means and use of a surface protective material which is difficultly oxidized or adhered by the substance causing the smearing or the like are enumerated, which show an effect.

However, with recent rapid advancement of digitalization, when an image is created by collection of fine dots, the high-humidity smearing tends to appear particularly in a half-tone image. This necessitates further an improved performance.

For one of replies as the measure to prevent the high-humidity smearing concerning the present invention, as disclosed in Japanese Patent Application Laid-Open No. 9-204056, there is proposed a method wherein in a photosensitive member having amorphous silicon as its sensitive layer, the carbon amount of the surface of an electroconductive substrate which forms the photosensitive layer is increased so as not to be oxidized but easy to wear out the surface and at the same time the smoothness of the surface is enhanced so that removal of the substance causing the high-humidity smearing is made easy. This is defined by a value of the surface roughness measured by a surface roughness tester.

Also, in Japanese Patent Application Laid-Open No. 10-333350, there is disclosed a method wherein the photosensitive surface is polished inside the electrophotographic apparatus and the surface thereof is made flat, thereby achieving the same effect.

Further, with improvement of recent high picture quality of printed images, the toner having an average particle size smaller than the conventional one or the toner having a low melting point corresponding to an energy saving has come to be used, and not only in the above described cleaning step but also in a toner removal step performed at the same time with other steps, removal of the remained toner becomes difficult, and repeated copying sometimes leads to a problem of toner adherence wherein the remained toner adheres to the photosensitive member surface and thereby an image defect having a black point or a white point in the image is generated.

As a measure for solving the above described problem, as disclosed in Japanese Patent Application Laid-Open No. 9-297420, there is proposed a method of previously making rough the surface of the electroconductive substrate on which the sensitive layer is formed by cutting or a rotary ball mill equipment, in the photosensitive member having amorphous Si as its sensitive layer. The surface of the substrate is regulated by a value of the surface roughness of $\mu$m order measured by the surface roughness tester.

Also, in Japanese Patent Application Laid-Open No. 8-129266, a value of the surface roughness Ra is regulated. However, this regulates a processing shape of the electroconductive substrate and the substrate surface is regulated by a value of the surface roughness of $\mu$m order measured by the surface roughness tester.

However, due to the from recent advancement of digitalization of the electrophotographic apparatus and enhanced awareness of ecology, while the fact that an amorphous photosensitive member is still used, prolongation of the life of the photosensitive member and an energy saving are further required.

Concretely, the attempt of raising the life of the photosensitive member of a low speed, a medium speed printer for personal use or the like to the level equal to or more than the life of the main apparatus, reducing a waste material and abolishing the use of a photosensitive member heater of a high speed printer for office use or the like while maintaining its life at a level equal to or more than the life of the main apparatus are required.

For this purpose, the photosensitive member is required to have such a constitution as to prevent the high-humidity smearing without depending on a wear or a polish which imposes a limit to the life of the photosensitive member, that is, to satisfy all the above even when the photosensitive member heater is abolished.

Also, in recent years, accompanied by advancement of digitalization of an electrophotographic apparatus, a latent image formation by a light source mainly comprising a single wavelength is becoming the mainstream. This sometimes leads to a problem that the above proposed method of cutting the substrate in advance causes a difference in an incident exposure amount to photoconductive layers due to the substrate shape and as a result a stripe pattern is generated on the printed image. Also, in order to prevent an interference fringe by reflection of light which reaches the substrate, the establishment of a new step of previously making the surface of the electroconductive substrate rough leads to a high cost. On the contrary, when the substrate is processed within the range of roughness where the above described stripe pattern is not generated, the toner adherence can not be sufficiently inhibited.

SUMMARY OF THE INVENTION

An object of the present invention is to provide an electrophotographic photosensitive member and an electrophotographic apparatus capable of preventing a high-humidity smearing and forming an excellent image.

Another object of the present invention is to provide a photosensitive member and an image forming apparatus which prevents the high-humidity smearing at the time of cleaning and achieves the excellent image formation.

Still another object of the present invention is to provide a photosensitive member and an image forming apparatus which prevents the toner adherence at the time of cleaning and achieves the excellent image formation.

A further object of the present invention is to provide an electrophotographic photosensitive member comprising a photoconductive layer containing at least amorphous Si and a surface protective layer which are stacked in order on an electroconductive substrate, wherein the electrophotographic photosensitive member has a difference in the height of concave and convex corresponding to 90% and 50% of the cumulative frequency of the concave and convex within the range of 3 nm to 200 nm with the most deepest point of the surface roughness concave and convex within the range of 10 $\mu$m×10 $\mu$m of the above described photosensitive member as a standard.

A still further object of the present invention is to provide an image forming apparatus comprising:

an electrophotographic photosensitive member comprising a photoconductive layer containing at least amorphous Si and a surface protective layer which are stacked in order on an electroconductive substrate, wherein the member has a difference in the height of concave and convex corresponding to 90% to 50% of the cumulative frequency of the concave and convex height within the range of 3 nm to 200 nm with the most deepest point of the surface roughness concave and convex within the range of 10 $\mu$m×10 $\mu$m of the above described photosensitive member as a standard;

charging means for the photosensitive member;

exposing means for forming an electrostatic image; and developing means for visualizing the latent image.

As a result of the sharp study by the present inventors, it was revealed that the effect of preventing the high-humidity smearing is not necessarily deteremined by macroscopic substrate surface roughness but rather largely depends on inherent microscopic (concretely, from several nm to several tens nm order) surface roughness of the amorphous silicon film.

It was also revealed that the effect of preventing the toner adherence is not necessarily determined by the substrate surface roughness of $\mu$m order measured by the surface roughness tester, but rather largely depends on the inherent microscopic (concretely, from several nm to several tens nm order) surface roughness of the amorphous Si film.

That is, it became clear that film formation in the shape having a few, shallow valleys between mountains (convex portions) at the time of growth of the amorphous silicon film immediately prevented the high-humidity smearing from the beginning and maintained an excellent level.

Further it was concluded that the macroscopic roughness, that is, a substrate cutting processing, a plastic processing or the like are preferably appropriately selected for the purpose of preventing the melting, the toner adherence or the like and maintaining separation stability, and even in this case, when the film is formed under the microscopic surface roughness condition as proposed by the present invention, the high-humidity smearing can be prevented from the beginning.

The separation stability as described here is referred to as stability of a step for separating a transfer material from the photosensitive member after the photosensitive member and the transfer material are brought into contact so that the toner on the photosensitive member surface is moved to the transfer material. Concretely, the toner once transferred to the transfer material will never return to the photosensitive member again, and the degree of a state where the transfer material is excellently separated and no paper jamming is generated is expressed by a paper jamming rate (hereinafter referred to as "jamming rate"). According to the study by the present inventors, for the purpose of maintaining this separation stability, it is preferable that a certain degree of the concave and convex is available on the surface of an a-Si photosensitive member and it is assumed that a surface energy state caused by the gap or the concave and convex formed by the transfer paper and its concave and convex at the time of contacting the transfer paper contributes to the separation stability.

The present inventors found as the result of repeated studies for solving the above described problem that, in the photosensitive member formed by stacking in order the photosensitive layer containing at least amorphous Si and the surface protective layer on an electroconductive substrate, with the most deepest point of the surface roughness concave and convex within the range of 10 $\mu$m×10 $\mu$m, to use another expression, the lowest point as a standard, the difference in the height of the concave and convex corresponding to 90% and 50% of the cumulative frequency of the frequency distribution of the concave and convex height is set within the range of 3 nm to 200 nm so that the above described problem can be solved.

As the means for adjusting to a preferable range the difference in the height of the concave and convex corresponding to 90% and 50% of the cumulative frequency of the concave and convex height with respect to the most deepest point, as a standard, of the surface roughness concave and convex within the range of 10 $\mu$m×10 $\mu$m according to the present invention, the following method can be used.

There are a method of dry-polishing or wet-polishing to obtain a desired surface roughness by using as a polishing agent a fine powder such as of silica, chromium oxide, titanium oxide, iron oxide, zirconium oxide, diamond, nitrogen carbide, silicon carbide, silicon nitride or cerium oxide; and a method of obtaining a desired surface roughness by buff-polishing, magnetic polishing, magnetic fluid FFF (Fluid assisted Fine Finishing), electrophoresis utilizing FFF, plasma utilizing FFF, EEH (Elastic Emission Hacking) or polishing by use of a lapping film. When the difference in the height of the concave and convex is smaller than a desired value, it can be made lager by using these methods.

FIG. 17A is a schematic representation for showing the polishing apparatus for the surface of an electrophotographic photosensitive member. FIG. 17A, reference numeral 1 denotes an electrophotographic photosensitive drum having a surface layer to be processed on a surface thereof. Reference numeral 2 denotes a polishing tape having a crystal SiC coated on a polishing surface thereof, which is the trade name of Lapping Tape LT-C2000, manufactured by Fuji Film. Reference numeral 3 denotes a cylindrical support for contacting the surface of the photosensitive drum 1 with the polishing tape 2. As the polishing tape used in the present invention, in addition to the tape having crystal SiC coated on its surface, it is preferable to use a tape having a powder such as of iron oxide, alumina or diamond coated on its surface. Reference numeral 4 denotes a pedestal for the cylindrical support 3, which is arranged in parallel to the revolution axis direction of the photosensitive drum 1 and to which a weight 5 is applied as a load. Reference numeral 6 denotes a delivery motor for delivering the polishing tape 2 which is delivered at a constant rate and pulled by a weight 7 to convey at a constant rate. In this case, since the polishing tape is conveyed in the forward direction of revolution of the photosensitive drum, polishing can be conducted without accumulating a polishing powder of SiC and foreign matters in a gap between the polishing tape 2 and the photosensitive drum 1, whereby a desired surface roughness can be obtained. When the surface roughness is larger than a desired value, it can be made smaller by this method.

FIG. 17B is a sectional view taken in the line 17B—17B of the polishing apparatus of FIG. 17A. The photosensitive drum 1 can move in the direction of its revolution axis (direction of arrows X). The polishing tape 2 and the cylindrical support 3 may be moved. By these operations, two-dimensional polishing can be controlled and therefore a desired surface roughness can be more easily obtained.

That is, it was revealed that, in the photosensitive member formed by stacking in order the photosensitive layer containing at least amorphous Si and the surface protective layer, on an electroconductive substrate with the most deepest point of the surface roughness concave and convex within the range of 10 $\mu$m×10 $\mu$m, to use another expression, the lowest point as a standard, the difference in the height of the concave and convex corresponding to 90% and 50% of the cumulative frequency of the frequency distribution of the concave and convex height is set within the range of 3 nm to 35 nm, preferably within the range of 5 nm to 30 nm so that particularly the high-humidity smearing can be inhibited. This led to the completion of the present invention.

Or it was found that, in the photosensitive member formed by stacking in order the photosensitive layer containing at least amorphous Si and the protective layer on an electroconductive substrate, with the most deepest point of the surface roughness concave and convex within the range of 10 $\mu$m×10 $\mu$m, to use another expression, the lowest point as a standard, the difference in the height of the concave and convex corresponding to 90% and 50% of the cumulative frequency of the concave and convex height is within the range of 35 nm to 200 nm, preferably within the range of 45 nm to 180 nm so that particularly the toner adherence can be inhibited. This led to the completion of the present invention.

The microscopic surface roughness in the present invention indicates a value of surface roughness Ra measured by an atomic force microscope (AFM) (Q-Scope 250 made by Quesant Corporation) and, for the purpose of measuring the microscopic surface roughness with high accuracy and excellent repeatability, it is desired to be within the measurement range of 10 $\mu$m×10 $\mu$m and to be a result measured in such a manner as to avoid an error due to a sample curvature inclination (tilt). Concretely, a correction (parabolic) is enumerated wherein, by a tile removal mode of Q-scope 250 made by Quesant Corporation, the curvature of the AFM image of the sample is allowed to fit with a parabola and then is made flat. The electrophotographic photosensitive member usually takes a cylindrical shape, and therefore this is a preferred technique to be employed. Further, when there remains a tilt in the image, a correction for removing the tilt is performed (line by line). In this way, the tilt of the sample can be appropriately corrected within the range not to cause a distortion in data.

Further, the present inventors found that in addition to the above described surface shape, constituting the photoconductive layer with a plurality of layers expedites an inhibition of the toner adherence.

The fluctuation of the substantial absorption depth of the image exposure caused by a band gap of the photoconductive layer generates fluctuation of the potential of the latent image. This potential fluctuation, concretely the remaining potential and the ghost potential are considered to deteriorate a fog which becomes a core for the toner adherence or freshness of a picture image.

It was also found that by continuously changing the interface compositions of the surface protective layer and the photosensitive layer of the photosensitive member, the control of the toner adherence can be further effectively performed.

It is desirable that a spectral reflectance in the above described interface compositions satisfies the following equation (1):

$$0 \leqq (Max-Min)/(Max+Min) \leqq 0.4 \quad (1)$$

where, when using light having the range of a wavelength from 450 nm to 650 nm, Min denotes the minimum value of a reflectance (%) and Min denotes the maximum value.

Here, the reflectance of the present invention indicates a value of the reflectance (percent) measured by using a spectrophotometer (MCPD-2 manufactured by OHTSUKA ELECTRON COMPANY). To describe its outline, first, a spectral luminous intensity I (O) of the light source of a spectrograph is taken and next, a spectral reflective light intensity I (D) of a photosensitive member is taken and then a reflectance R=I(D)/I(O) is determined. To measure with high accuracy and excellent repeatability, it is desirable to fix the detector by a jig so that its angle is made constant against the photosensitive member having a curvature.

Concrete examples of the interface control are shown in FIGS. 1A and 1B. The curves A and B in FIG. 1A show example A (value of equation (1): 0.48) and example B (value of equation (1): 0.41), respectively, which are measurement examples in "the presence of an interface" and are out of the range of the above described equation. The curves C and D in FIG. 1B show example C (value of equation (1): 0.28) and example D (value of equation (1): 0.16), respectively, which are measurement examples in "the absence of an interface" satisfying the equation according to the present invention. The reason why there are two curves is because of the differences in the film thickness of each surface protective layer, and the wave form moves left and right on the graph responding to the differences in the film thickness. Because the maximum value thereof corresponds to the amplitude of the wave form, in contrast to the absence of the interface, when viewed from a fixed simple wavelength, the presence of the interface largely fluctuates in its reflectance against the fluctuation of the film thickness.

That is, a fine roughness causes the substantial fluctuation of film thickness of a surface protective layer on the picture image exposure incident light path. This fluctuation of the film thickness makes the fluctuation of the sensitivity larger in the presence of the interface than in the absence of the interface, and it is considered that this causes the fog which becomes a core for the toner adherence or deteriorates freshness of the picture image.

(Frequency Distribution of Surface Roughness)

Hereinafter, the frequency distribution of the surface roughness which is an important index of the present invention will be described.

The atomic force microscope (AFM) exceeds 0.5 nm in the horizontal resolution (resolution in a parallel direction to a sample surface) and has 0.01 to 0.02 nm in the vertical resolution (resolution in a vertical direction to the sample surface) and can measure a three dimensional shape of the sample. A significant difference from the surface roughness tester widely used in the past resides in its high resolution.

In the resolution of as much a high degree as this, it is possible to measure not the roughness of an order where the roughness of the photosensitive member substrate is dominant but the roughness originating from the nature of a deposited film itself such as the photoconductive layer and the surface layer.

Although the roughness of the photosensitive member substrate depends on the "mold" such as the above described lathe, the ball mill or a "tooth shape" such as a dimple processing and a "processing member", no "mold" exists in the roughness of the deposited film, but there exists a shape factor which can not be sufficiently expressed by Ra (center line average roughness) and Rz (ten points average roughness) merely defined by JIS-B0601. The present inventors thought that the shape factor could be the clue to the above described toner adherence prevention.

Concretely, under various conditions, the amorphous silicon photosensitive layers (all the layers including the interface of each layer such as the preventive layer, the photoconductive layer and the surface layer) are produced on the electroconductive substrate having the surface roughness Ra of 10 nm within the range of the same visual field (10 $\mu$m×10 $\mu$m). Then the concave and convex height thereof was measured by the atomic force microscope, and the frequency distribution thereof was determined, compared and studied.

In the same measurement by the conventional surface roughness tester widely used, for example, a contact type surface roughness tester (SE-3400) made by KOSAKA LABORATORY CORPORATION, a significant difference cannot be observed, while the index used by the present invention is considered to be an index showing the characteristics of the material of the amorphous silicon photosensitive member, which draws a clear line of demarcation against the conventional tester.

It should be noted that the present inventors, at the time of the AMF measurement, conducted the measurement of several samples in several scan sizes. The scan size is a length of one side of a square to be scanned, and accordingly a scan size of 10 $\mu$m is to scan the range of 10 $\mu$m×10 $\mu$m, that is, 100 $m^2$. By taking a graph abscissa as the scan size, a part of the result will be shown in FIG. 2.

FIG. 2 shows two sample films formed on the same substrate under different forming conditions having a relatively small minute roughness and a medium roughness by a measurement visual field and a roughness index JIS-Ra (central line average roughness) which is generally easy to image. In FIG. 2, symbol ■ shows the sample film having a relatively small minute roughness, and symbol ♦ shows the sample film having a medium roughness.

When the scan size is enlarged, that is, when the measurement range is enlarged, the measurement value is stabilized. However, depending on a substrate swelling of the sample substrate, a peculiar shape such as a projection and an influence of the processed shape, the measurement becomes hard to reflect the minute shape. When an angle of visibility becomes small, selected variations of measurement places become large. Hence, the present invention used a 10 $\mu$m×10 $\mu$m visual field which is collectively excellent in measurement detection performance and stability.

From the above described circumstances, the present invention is not limited to the visual field of 10 $\mu$m×10 $\mu$m.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DETAILED DESCRIPTION OF THE PREFERRED EMBODIMENT

Hereinafter, the present invention will be described with reference to the drawings as occasion demands.

(a-Si Photosensitive Member According to the Present Invention)

Figure 1A:
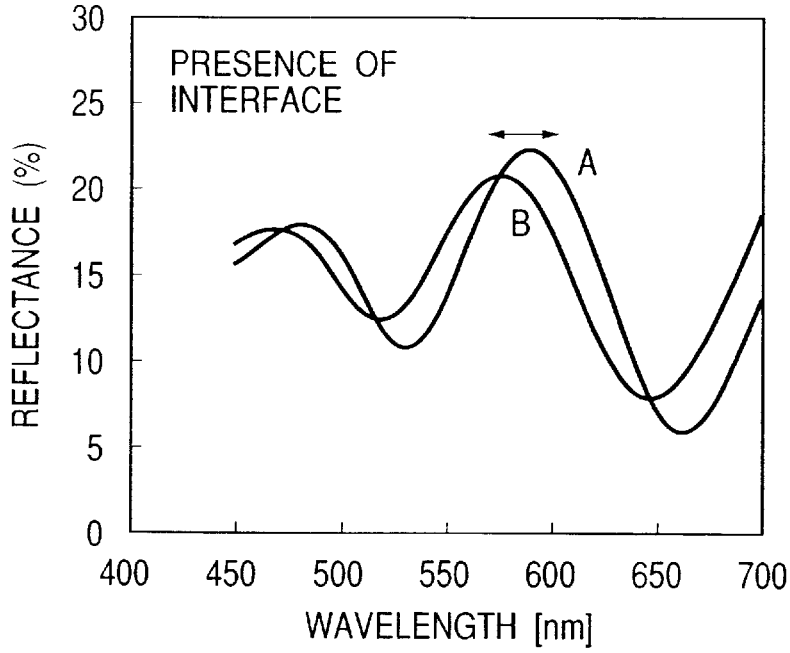
FIGS. 1A and 1B are graphs for explaining the interface reflection control of a surface protective layer.
Figure 1B:
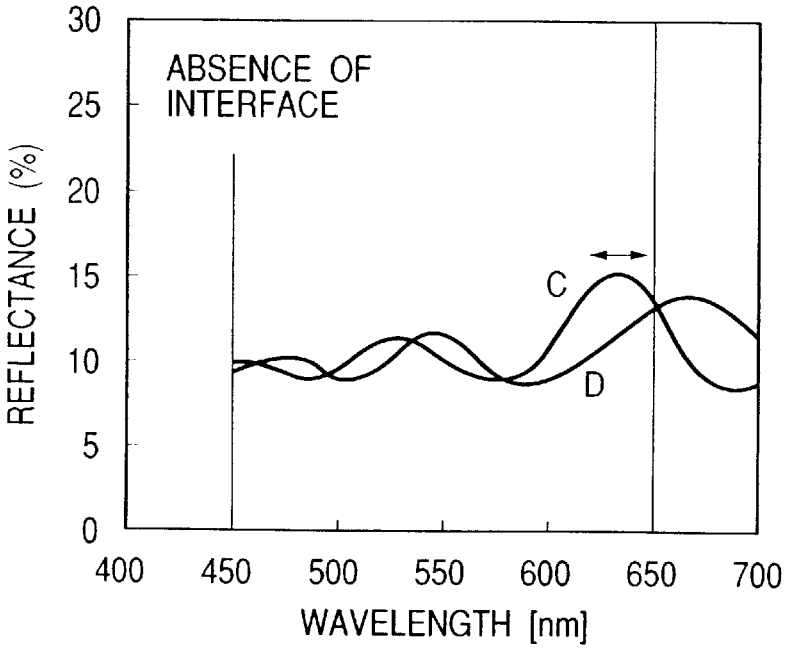
Figure 2:
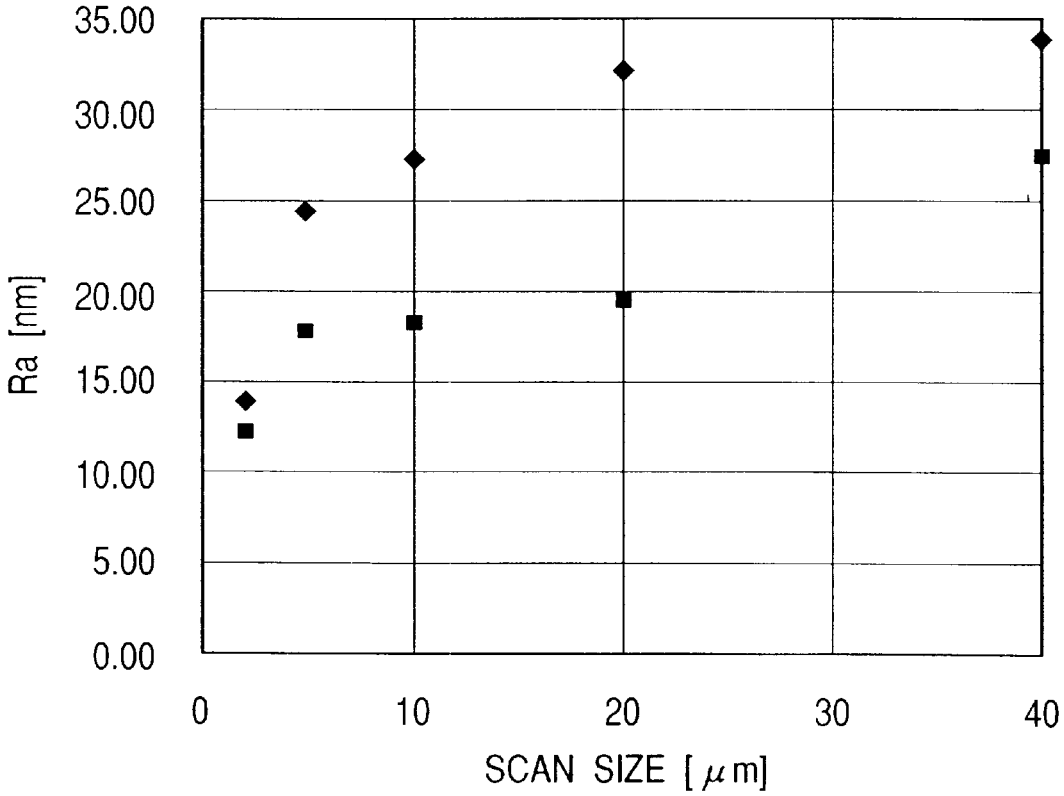
FIG. 2 is a graph for explaining a measurement range of an AMF.
Figure 3A:
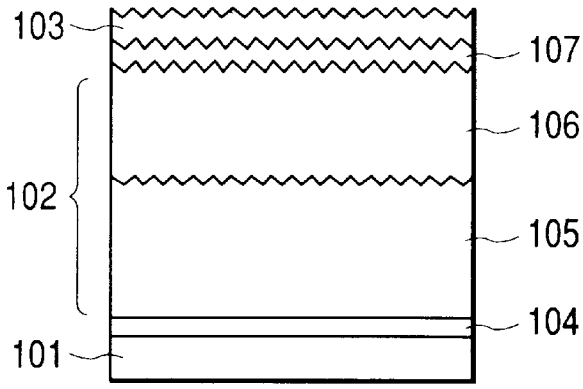
FIGS. 3A, 3B and 3C are schematically sectional views for explaining one example of the constitution of an electrophotographic photosensitive member.
Figure 3B:
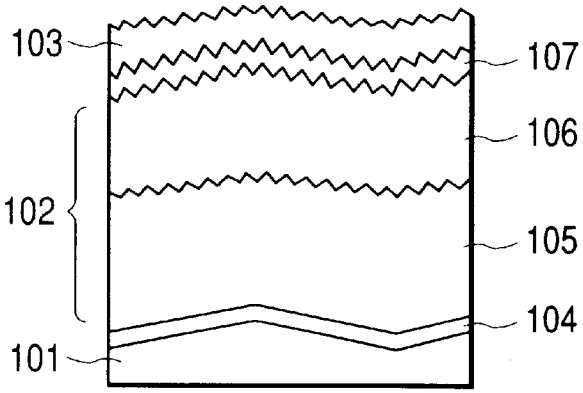
Figure 3C:
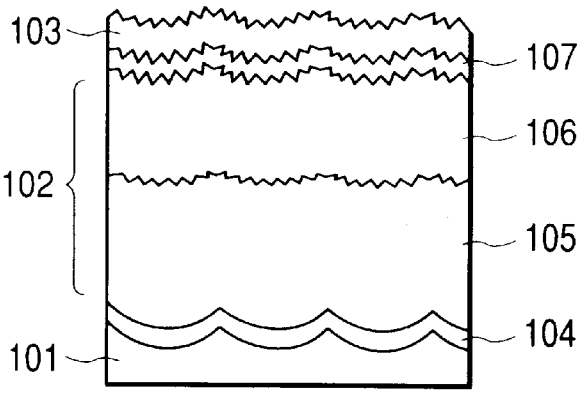

FIG. 3A to FIG. 3C are schematically sectional views for explaining a partial section of a functional layer stacked on the substrate in an example of the electrophotographic photosensitive member according to the present invention.

The electrophotographic photosensitive member of the present invention is, as shown in FIG. 3A to FIG. 3C, the member has a photoconductive layer 102 and a surface protective layer 103 which are stacked in order on a substrate 101 comprising an electroconductive material such as Al, stainless or the like. Note that, in addition to these layers, various functional layers such as a blocking layer 104, an antireflection layer or an interface layer 107 or the like may be disposed as occasion demands. For example, the blocking layer 104, the interface layer 107 or the like are disposed, and the dopant thereof is selected from Group III elements, Group V elements in the Periodic Table or the like so that charging polarity such as positive charging or negative charging can be controlled.

The substrate shape may be a desired shape according to the drive system of the electrophotographic photosensitive member or the like. For the substrate material, the electroconductive material such as the above described Al and stainless are generally used. However, the substrate given electroconductivity by evaporating these electroconductive materials on a material especially having no electroconductivity, for example, such as various kinds of plastics, ceramics or the like can be also used.

For the photoconductive layer 102, an organic layer or an inorganic layer can be enumerated if it has photoconductivity. For the inorganic photoconductive member, a non-single-crystal material containing silicon atoms, hydrogen atoms and halogen atoms, preferably an amorphous material (abbreviated as "a-Si (H,X)" or a-Se or the like can be enumerated as representative materials. Also, the film thickness of the photoconductive layer 102 is not limited and however, considering a manufacturing cost or the like, the thickness is suitably about 15 $\mu$m to about 50 $\mu$m.

Further, to improve the characteristics, a constitution having a plurality of layers may be employed by further disposing a lower photoconductive layer 105 and an upper photoconductive layer 106. Particularly, for a light source having a relatively long wavelength and yet hardly any wavelength variation like a-semiconductor laser, elaborating such a layer constitution can bring about dramatic effects.

The surface protective layer 103 is generally formed by amorphous silicon carbide a-Sic (H,X), but may be also formed by amorphous carbon a-C (H,X). Lubricity, oxidation resistance and hardness of the surface allow a-C (H,X) to be dominant, which is more preferable. Also, it is preferable that the interface component 107 of the photoconductive layer 102 and the surface protective layer 103 are continuously changed so that an interface reflection of the above described portion can be inhibited (refer to FIGS. 3B and 3C).

Further, as the means for adjusting to a preferable range the difference in the height of the concave and convex corresponding to 90% and 50% of the cumulative frequency of the concave and convex height with respect to the most deepest point, as a standard, of the surface roughness concave and convex within the range of 10 $\mu$m×10 $\mu$m according to the present invention, it is possible to suitably adjust the concave and convex of the surface of a substrate before formation of a deposited film, and after formation of a deposited film a post-treatment such as polishing may conducted where necessary.

Concretely, (1) for the concave and convex control of the remarkably fine surface of a deposited film according to the present invention, it is preferable that a substrate is smooth in the range of the measurement according to the present invention, and therefore the substrate is subjected to a desired processing by cutting means such as a lathe, and (2) polishing can be conducted while suitably adjusting polishing conditions mainly depending on the characteristics of a deposited film and also depending on film forming conditions, mainly a gas decomposition frequency and an applied power, of course, formation conditions of a deposited film. The polishing can be conducted by using, for example, a tape attached with fine particles of SiC (SiC polishing tape) and rubbing the surface of the photosensitive member on which a film is formed with the tape.

(a-Si Photosensitive Member Film Forming Apparatus According to the Present Invention)

Figure 4:
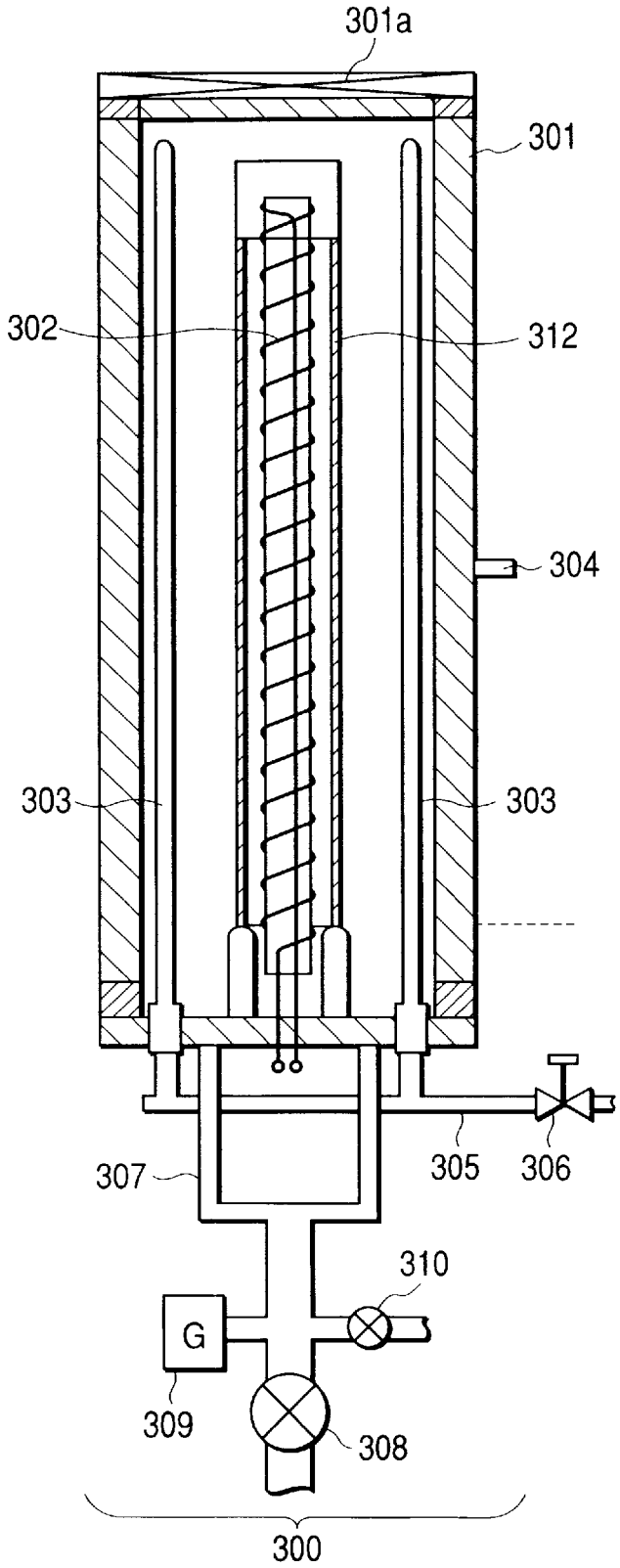
FIG. 4 is a schematically sectional view for explaining one example of a film forming apparatus which can be used for producing an a-Si photosensitive member.

One example of the a-Si photosensitive member film deposition apparatus according to the present invention will be described with reference to FIG. 4.

In the present invention, a photosensitive drum comprises an a-Si photosensitive member, and the photosensitive layer is formed by a high-frequency plasma CVD (PCVD) method. The PCVD apparatus usable in the present invention will be shown in FIG. 4. The apparatus shown in FIG. 4 is a general PCVD apparatus usable in manufacturing the electrophotographic photosensitive member. This PCVD apparatus is provided with a deposition apparatus 300, a raw material gas supply apparatus and an exhauster (both of which are not shown). The deposition apparatus 300 is provided with an reaction container 301 comprising a vertical vacuum container. In the internal periphery side of this reaction container 301, the raw material gas introduction pipe 303 arranged in the vertical direction is disposed in plurality, and on the side face of the gas introduction pipe 303 a number of minute holes are disposed along a longitudinal direction. In the center inside the reaction container 301, a spirally wound heater 302 is extendedly disposed longitudinally and a cylindrical body 312 which becomes a substrate of the photosensitive drum is inserted by opening an upper lid 301*a* of the container 301 and arranged vertically so that the heater 302 is provided inside the container 301. Also, from a convex portion 304 disposed at one of the side faces of the reaction container 301, a high frequency electric power is supplied.

On the lower portion of the reaction container 301, a raw material gas supply pipe 305 connected to the raw gas introduction pipe 303 is attached. This supply pipe 305 is connected through a supply valve 306 to a gas supply apparatus not shown. Also, on the lower portion of the reaction container 301, an exhaust pipe 307 is attached. This exhaust pipe 307 is connected through a main exhaust valve 308 to the exhauster (vacuum pump) not shown. On the exhaust pipe 307, additionally, a vacuum gage 309, a sub exhaust valve 310 are attached.

The formation of the a-Si photosensitive layer by the PCVD method using the above described apparatuses is performed as follows. First, the cylindrical body 312 which becomes the substrate of the photosensitive drum is set inside the reaction container 301 and, after the lid 301*a* is closed, the inside of the reaction container 301 is exhausted by the exhauster (not shown) up to a pressure not more than a predetermined low pressure. After that, while the exhaust is continued, the substrate 312 is heated from the inside by heater 302 and controlled at a predetermined temperature within the range of 20° C. to 450° C. When the substrate 312 is maintained at the predetermined temperature, a desired raw material gas, while adjusted by each flow controller (not shown), is introduced into the inside of the reaction container 301 through the introduction pipe 303. The introduced raw material gas, after filling inside the reaction container 301, is exhausted from the container 301 by passing through the exhaust pipe 307.

In this way, when the fact that the inside of the reaction container 301 filled with the raw material gas reaches the predetermined pressure so as to be stabilized is confirmed by a vacuum gage 309, by a high frequency electric power source not shown (RF band of 13.56 MHz or VHF band of 50 to 150 MHz or the like), a high frequency is introduced into the inside of the container 301 with a desired input electric energy, thereby generating a glow discharge in the inside of the container 301. By the energy of this glow discharging, the component of the raw material gas is decomposed to generate plasma ion in the inside of the container 301 so that an a-Si deposited layer mainly composed of silicon is formed on the surface of the substrate 312. At this time, the parameters such as a type of gas, a gas introduction amount, a gas introduction ratio, a pressure, a substrate temperature, an input electric power, a film thickness or the like are adjusted so that the a-Si deposited layers of various characteristics are formed, thereby enabling to control the electrophotographic characteristics.

In this way, when the a-Si deposited layer with a desired film thickness is formed on the surface of the substrate 312, the high frequency electric power supply is stopped and the supply valve 306 or the like are closed, and the introduction of the raw material gas into the inside of the reaction container 301 is stopped, and thus the formation of the a-Si deposited layer of one layer portion is terminated. By repeating the same operation plural times as occasion demands, the a-Si deposited layer of a desired multi-layer structure, that is, the a-Si photosensitive layer is formed and the photosensitive drum having the a-Si photoconductive layer of the multi-layer structure on the surface of the substrate 312 is manufactured.

Also, at the time when the formation of one layer portion of the a-Si deposited layer is completed, the reduction and the control of the interface reflection of the surface protective layer and the photoconductive layer according to the present invention can be achieved by not stopping the high frequency electric power and also by not stopping the raw material gas supply, but by continuously changing them to the electric power condition and the gas component of the next layer. Or instead, though the high frequency electric power is once stopped, the raw material gas is allowed to begin from the component of the previous layer and continuously change to a desired composition so as to deposit a film, thereby achieving the above described reduction and control.

In the above, by adjusting a longitudinal flow rate distribution in the introduction pipe 303 of the raw material gas introduced into the inside of the reaction container 301 from the minute holes longitudinally distributed of the gas introduction pipe 303, a flow velocity of a exhaust gas from the exhaust pipe, a discharge energy or the like, the electrophotographic characteristic along the longitudinal direction of a-Si deposited layer on the substrate 312 can be controlled.

(Electrophotographic Apparatus According to the Present Invention)

Figure 5:
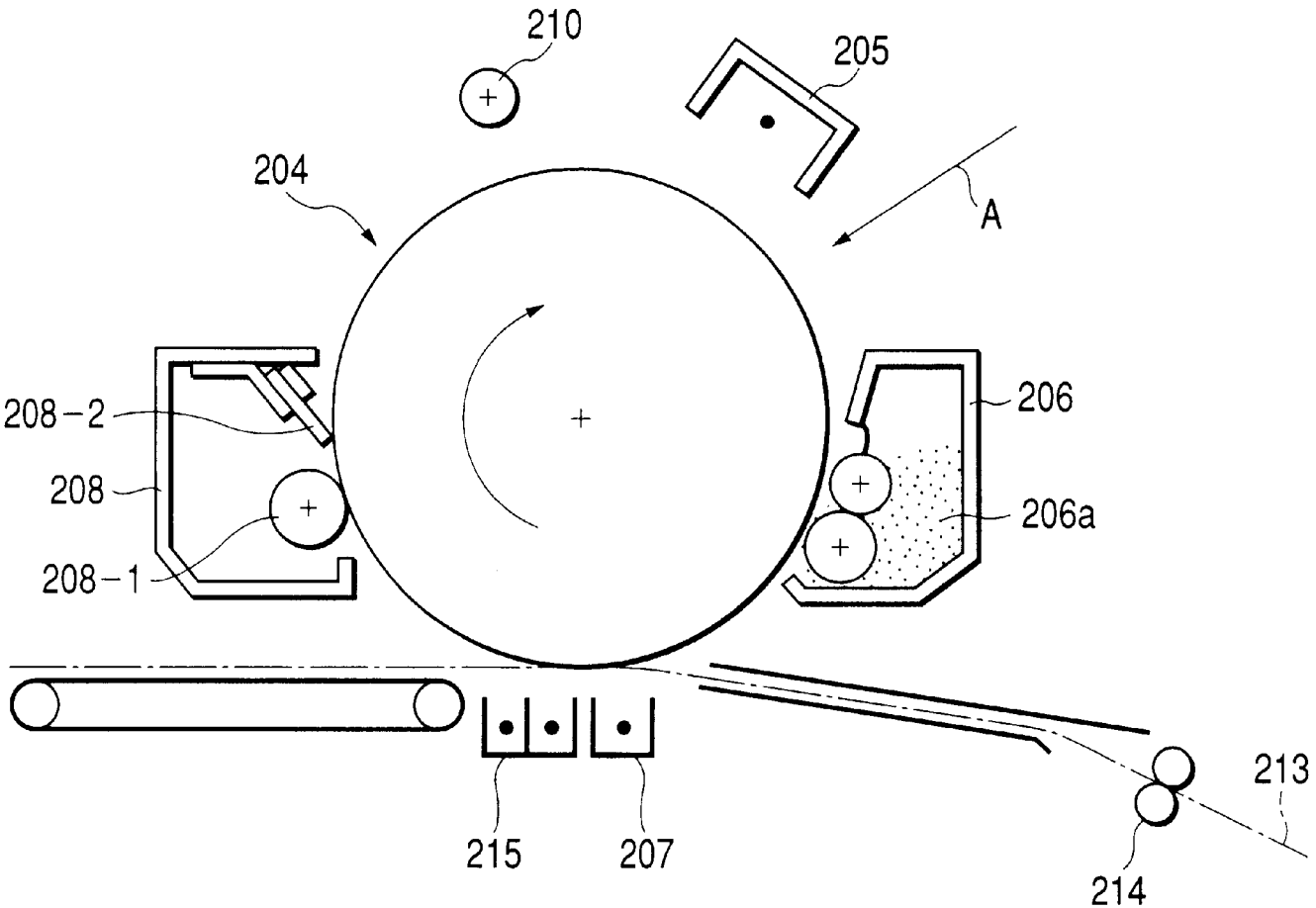
FIG. 5, FIG. 6 and FIG. 7 are schematically sectional views respectively for explaining an example of the constitution of the electrophotographic apparatus as an image forming apparatus.
Figure 6:
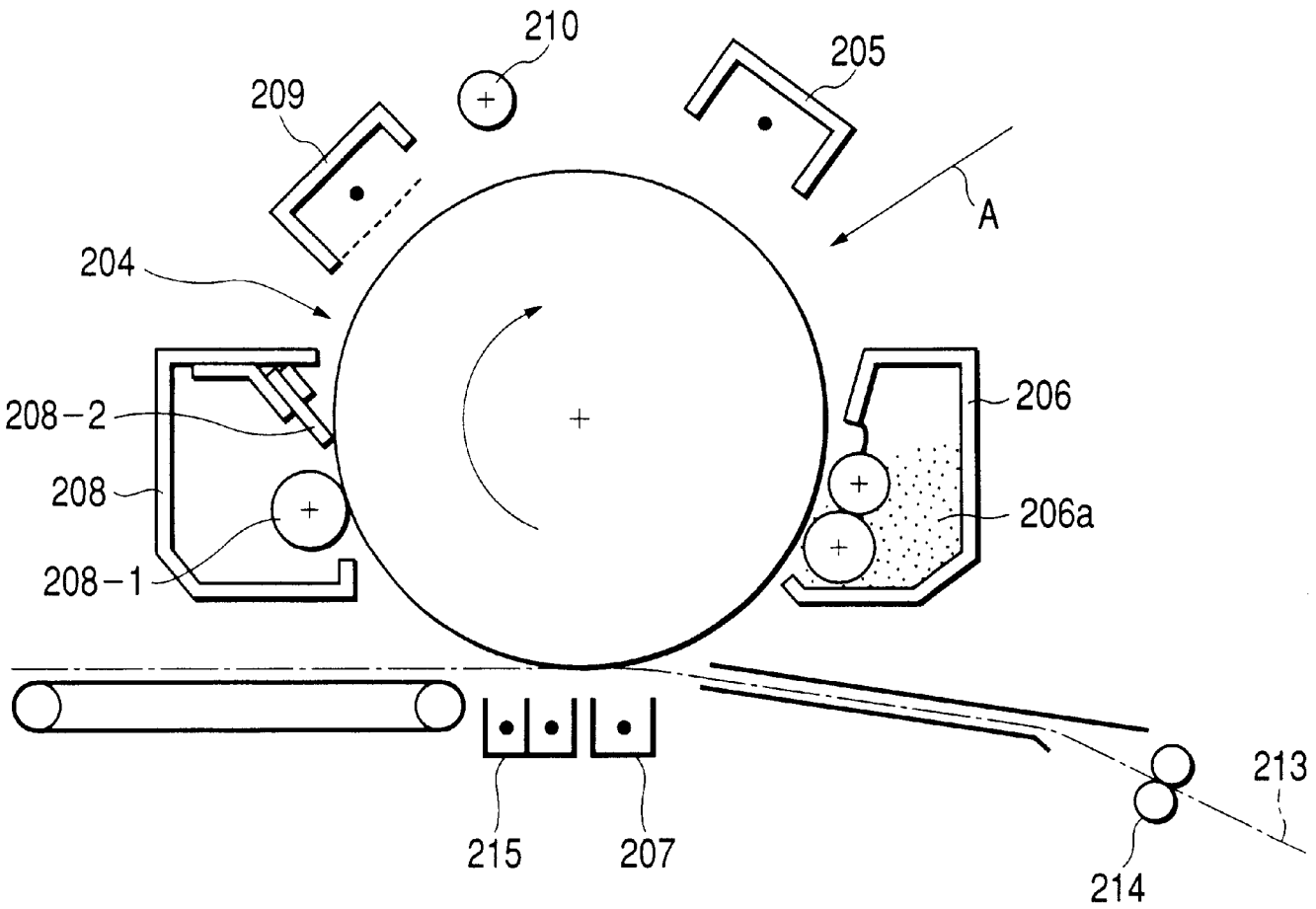

One example of the electrophotographic apparatus of the present invention using the electrophotographic photosensitive member produced in this way is shown in FIG. 5 and FIG. 6. Note that, though the apparatus of the present example is preferable for using the electrophotographic photosensitive member of a cylindrical shape, the electrophotographic apparatus of the present invention is not limited to the present example, but the photosensitive member shape may be of a desired shape such as an endless belt or the like.

In FIG. 5 and FIG. 6, around the electrophotographic photosensitive member 204 referred to the present invention, a primary charger 205 for performing charging for the formation of an electrostatic latent image on the photosensitive member 204, a developing device 206 for supplying a developer (toner) to the photosensitive member 204 where the electrostatic latent image is formed, a transfer charger 207 for transferring the toner on the photosensitive member surface to a transfer material 213 such paper or the like, and a cleaner 208 for cleaning the photosensitive member surface are arranged. To effectively perform a cleaning of the photosensitive member surface, the present example performs the cleaning of the photosensitive member surface by using an elastic roller 208-1 and a cleaning blade 208-2 as described above, but either one only may suffice. Also, between the cleaner 208 and the primary charger 205, an AC charge-eliminator 209 and a charge-eliminating lump 210 for performing charge-elimination of the photosensitive member surface in preparations for the next copying operation are disposed, and also the transfer material 213 is forwarded by a transfer roller 214. For the light source of an exposure A, the light source mainly having a halogen light source or a single wavelength is used.

In such an apparatus, the formation of a copy image is, for example, performed as follows. First, the electrophotographic photosensitive member 204 is rotated in an arrow direction at a predetermined velocity, and by using the primary charger 205, the surface of the photosensitive member 204 is uniformly charged. Next, on the surface of the charged photosensitive member 204, the exposure A of an image is performed, and the electrostatic latent image of the image is formed on the surface of the photosensitive member 204. When the portion where the electrostatic latent image of the surface of the photosensitive member 204 is formed passes through a disposing portion of the developing device 206, the developing device 206 supplies the toner on the surface of the photosensitive member 204 and the electrostatic latent image is visualized (developed) as an image by the toner 206*a*. Further, by the rotation of the photosensitive member 204, this toner image reaches a transfer charger 207 and is transferred onto the transfer material 213 forwarded by the transfer roller 214.

After the transfer is completed, by a separation charger, the transfer material is separated from the photosensitive member by utilizing an electrostatic force. The separation may be mechanically performed by using a belt, a claw or the like. In preparations for the next copying step, the remaining toner is removed from the surface of the electrophotographic photosensitive member 204 by the cleaner 208, and the potential of the above described surface is further charge-eliminated by the charge-eliminating lamp 210 so as to become zero or almost zero, thereby completing a single copying step.

Note that the difference between FIG. 5 and FIG. 6 is that in FIG. 6 the AC charge-eliminator 209 is disposed between the charge-eliminating lamp 210 and the cleaner 208. To more completely charge-eliminate the charge of the surface of the electrophotographic photosensitive member 204, such the AC charge-eliminator 209 may be disposed.

Figure 7:
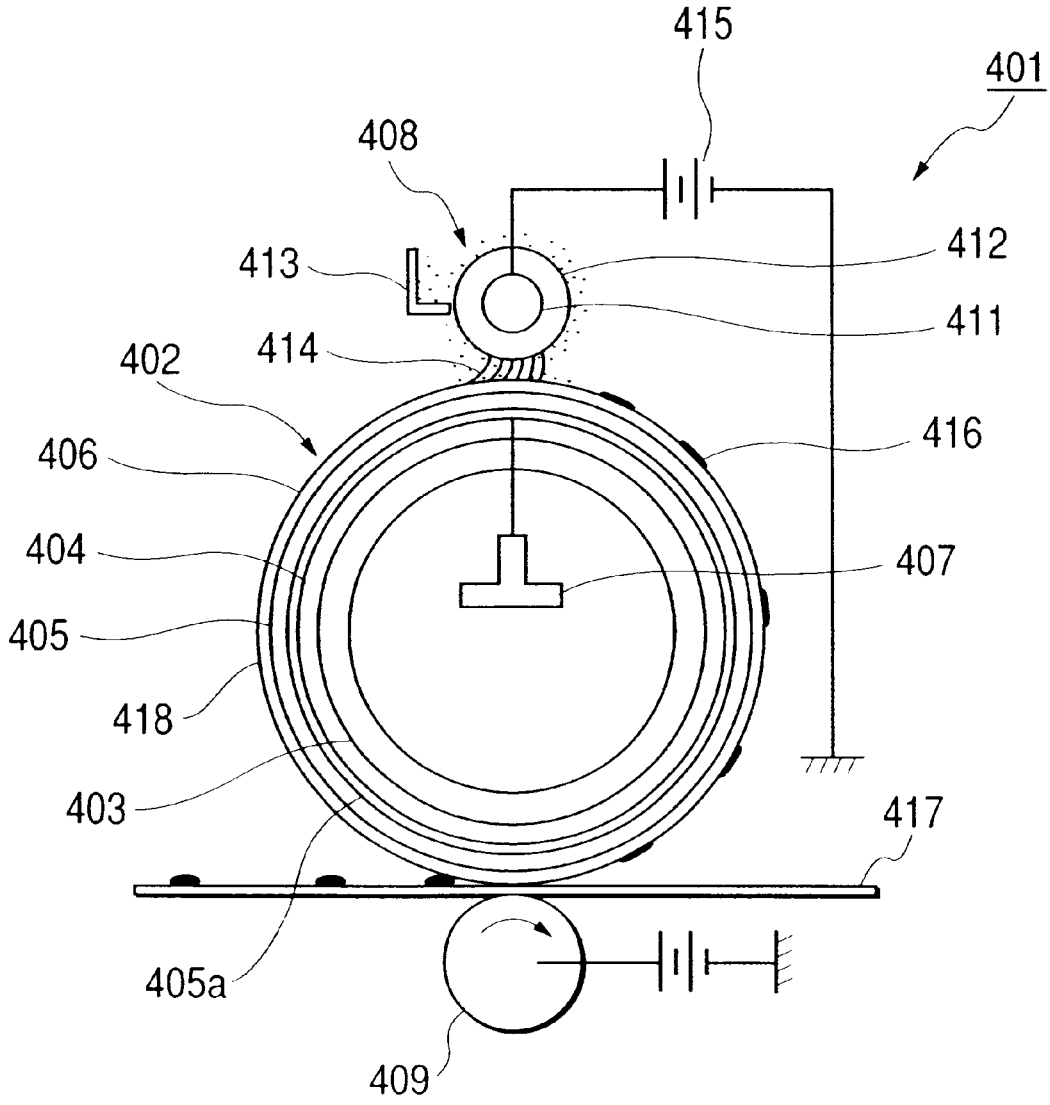

FIG. 7 is a schematic view showing the electrophotographic apparatus omitting the cleaning device according to the present invention. The electrophotographic apparatus 401 shown in FIG. 7 comprises the drum-shaped photosensitive member 402 stacked with a translucent electroconductive layer 404, an insulating carrier injection blocking layer 405*a*, the photoconductive layer 405 and the surface layer 406 on a translucent support 403, a LED head 407 as exposing means, a developing device 408 and a transfer roller 409. The LED head 407 and the developing device 408 are approximately symmetrically arranged through a certain part of the photosensitive member 402. Inside the photosensitive member 402, a LED array 410 as an erasing light source is arranged, which may be arranged outside of the photosensitive member 402. The developing device 408 comprises, for example, an octa-pole cylindrical magnetic pole roller 411 and an electroconductive sleeve 412 disposed across thereof. Further, one component magnetic electroconductive toner as a developer stored in a toner receiver 413 is delivered to the outer periphery of the sleeve 412 so as to form a magnetic brush 414. Also, between the sleeve 412 and the translucent electroconductive layer 404, a bias power source 415 is disposed, and between both of 404 and 415, a voltage of plus or minus 0 V to 300 V responding to the potential characteristics of the photosensitive member 402 is applied. On the surface of the photosensitive member 402, a toner layer 416 is formed and brought into contact with a recording paper 417. Reference numeral 418 denotes the remaining toner on the photosensitive member surface after brought into contact with the recording paper 417. Other than these constituents, rotating means of the developer and rotating means of the photosensitive member 402 are disposed.

Exposure is performed from the translucent supporting member side by an exposure device, and by a magnetic brush comprising the electroconductive magnetic toner on the developing device applied with a bias voltage by a developing bias supply power source, the surface of the photosensitive member is rubbed, thereby a charging, an exposure and a developing are simultaneously performed and a toner image is formed on the photosensitive member. This toner image is transferred on the recording paper by using the transfer roller and fixed by fixing means to become a recorded image. On the other hand, the toner remained on the photosensitive member is recovered by the developing device and recycled and therefore the cleaning device is omitted.

Hereinafter, the present invention will be described in detail based on various experiments.

(Experiment 1)

By using the above described a-Si photosensitive member film-forming apparatus and changing each parameter of the substrate shape and manufacturing conditions, electrophotographic photosensitive members Nos. 101 to 113 were manufactured, wherein the frequency distribution of the surface roughness in an AFM measurement level and the surface roughness Rz in a surface roughness tester measurement level were changed. For the electroconductive substrate, a cylindrical substrate comprising Al was used, wherein the substrate surface was subjected to processing such as a cutting processing, a dimple processing or the like.

Figure 8:
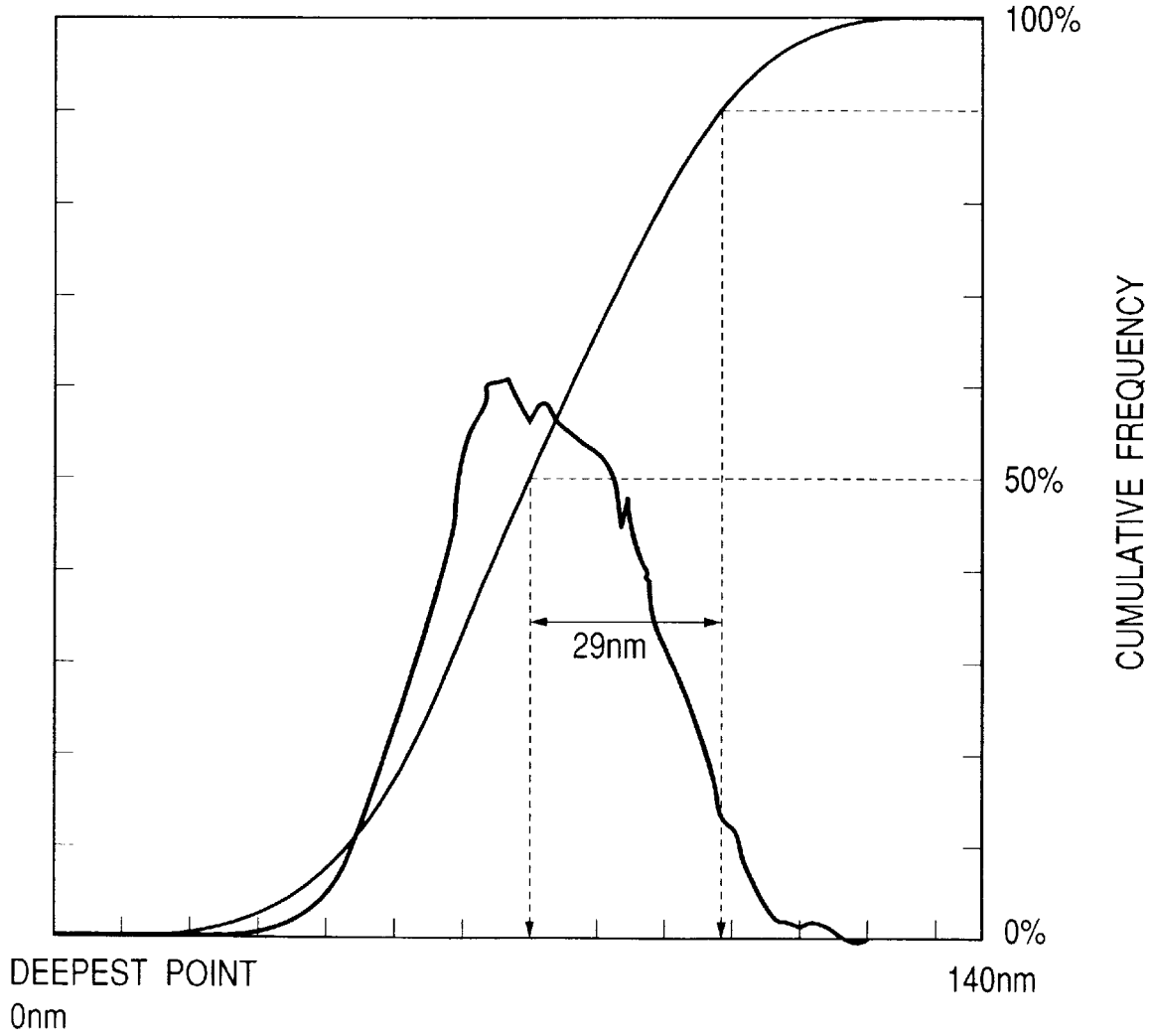
FIG. 8 and FIG. 10 are graphs respectively for explaining the difference in the height of the concave and convex corresponding to 90% and 50% of the cumulative frequency of the surface roughness.

With respect to some of the above described photosensitive members, concretely, with the most deepest point of the concave and convex of the surface roughness where No. 101 is measured by the AFM within the range of 10 $\mu$m×10 $\mu$m as a standard, the difference in the height of the concave and convex corresponding to 90% and 50% of the cumulative frequency of the height of the concave and convex is shown in FIG. 8. As is evident from this drawing, a width, a height and a balance of the left and the right of the frequency distribution allow characteristics to appear in the shape of the cumulative frequency. Further, the concave and convex corresponding to 90% and 50% of the cumulative frequency corresponds to the concave and convex of the topmost surface portion and is considered to be a portion playing a large part in the characteristics such as the high-humidity smearing.

The present invention, by aiming the difference in the height of the concave and convex corresponding to 90% and 50% of the cumulative frequency, shows in Table 1 the difference in the height of the concave and convex corresponding to 90% and 50% of the cumulative frequency of the surface roughness measured by the AFM within the range of 10 $\mu$m×10 $\mu$m of each photosensitive member of Nos. 101 to 113, the surface roughness Rz measured by the contact type surface roughness tester and the result of the image estimation.

Here, the surface roughness of $\mu$m order relates to a value of the surface roughness Rz measured in the estimation length of 1.25 mm by using the contact type surface roughness tester (Surf Coder SE-3400 manufactured by KOSAKA LABORATORY CO., LTD.).

Figure 9:
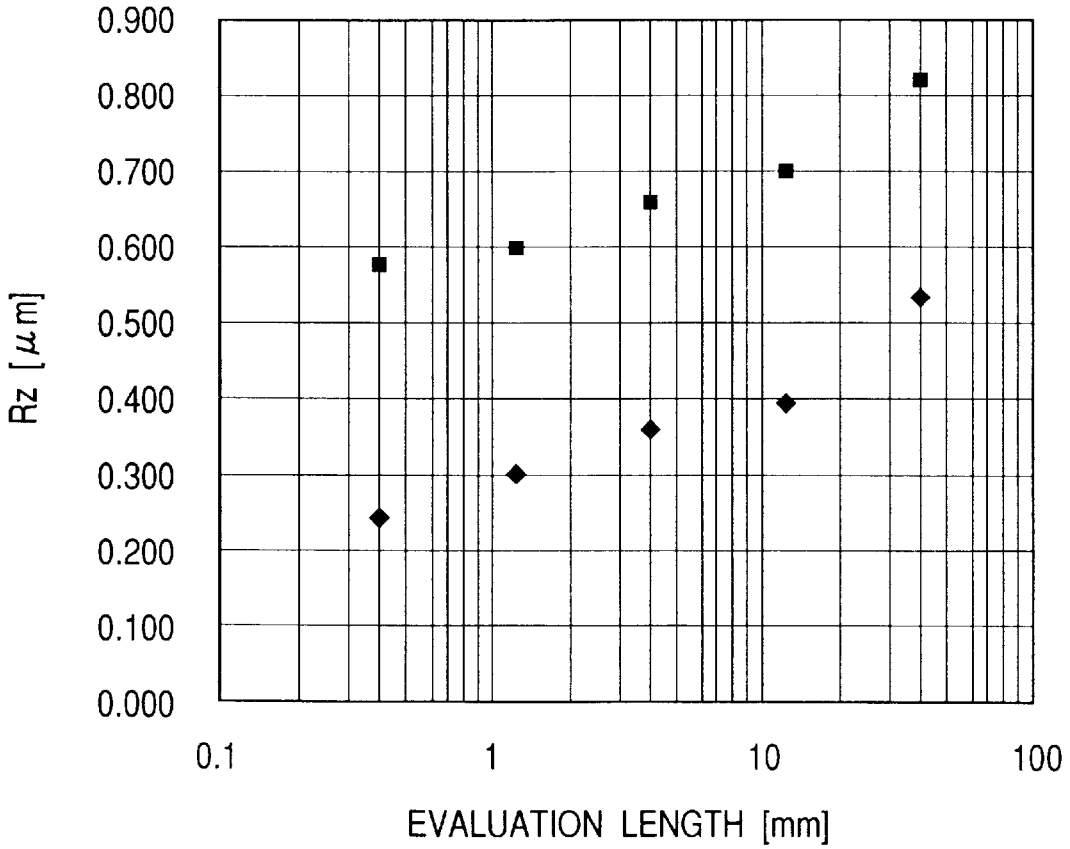
FIG. 9 and FIG. 11 are graphs for explaining an estimation length of the surface roughness tester.

Note that, at the time of measuring the above described surface roughness tester, the present inventors performed the measurement in several measurement lengths for several samples. A part of the results is shown in FIG. 9.

This drawing shows the estimation length and Rz (ten points average roughness) of the roughness index JIS-B0601 generally easy to image with respect to two samples having a relatively small roughness and a medium roughness of the films formed by changing the substrate and the manufacturing conditions.

The estimation length and Rz are mutually related. That is, if the estimation length is not regulated, an accurate roughness can not be specified and therefore the present invention specified the roughness by the surface roughness Rz measured in the estimation length of 1.25 mm.

The image estimation was made by using the CANON made electrophotographic apparatus NP6350 under 30° C. and a high humidity environment of 80% RH, wherein the passing-sheet endurance of 500,000 sheets was performed by a test pattern of 3% printing rate lowered than the usual printing rate and an original of an analogue image having a line width of 200 $\mu$m and an interval of 500 $\mu$m was copied and the estimation was made by a good or bad line width repeatability.

Also, separation stability periodically outputted a white image and a black image and was judged by a jam rate in the separation portion.

As reference symbols in Table 1, ◎ means "excellent (no problem)", ○ means "practically acceptable" and × means "possibly posing practical problem".

From the result of Table 1, there was no mutual relation found between the value of the conventional surface roughness Rz and the high-humidity smearing. On the contrary, there was a mutual relation found between the difference in the height of the concave and convex corresponding to 90% and 50% of the cumulative frequency and the high-humidity smearing.

(Experiment 2)

Next, by using the above described a-Si photosensitive member film forming apparatus and changing each parameter of the manufacturing conditions, the electrophotographic photosensitive members Nos. 201 to 212 where the frequency distribution of the surface roughness in the AFM measurement level and the surface roughness Rz in the surface roughness tester measurement level were changed and the similar photosensitive members Nos. 213 and 214 except that they were in absence of the interface were manufactured.

For the electroconductive substrate, a cylindrical substrate comprising Al with a purity equal to or more than 99.9% was used, which was treated with a mirror processing by cutting and the microscopic surface roughness Rz was standardized less than 9 nm.

The difference in the height of the concave and convex corresponding to 90% and 50% of the cumulative frequency of the surface roughness measured by the AFM within the range of 10 $\mu$m×10 $\mu$m of each photosensitive member of Nos. 201 to 214, the surface roughness Rz measured by the contact type surface roughness tester and the result of the image estimation are shown in Table 2.

The image estimation was made by using the CANON made electrophotographic apparatus NP6350 as it is, or the apparatus where the image exposure was modified to a LED array or a laser, wherein the passing-sheet endurance of 500,000 sheets was performed by using a test pattern of 3% printing rate lowered than the usual printing rate, and the estimation of the high-humidity smearing and the separation stability was made.

Figure 16:
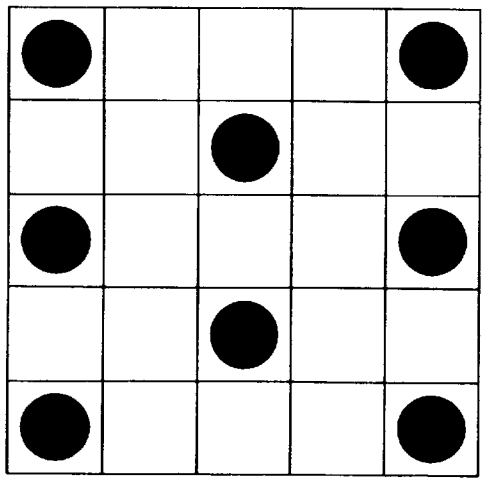
FIG. 16 is a KEIMA pattern.

In the case of an analogue image, an original having a line width of 200 μm and an interval of 500 μm was copied and the estimation was made by a good or bad line width repeatability. In the case of a digital image, from concentration uniformity of a half-tone image comprising an isolated dot formation of 25% printing rate or a KEIMA pattern as shown in FIG. 16, the estimation of the high-humidity smearing was made.

Also, separation stability periodically outputted a white image and a black image and was estimated by the jam rate in the separation portion.

As reference symbols of Table 2, ◎ means "excellent (no problem)", ○ means "practically acceptable" and × means "possibly posing practical problem".

From the result of Table 2, the photosensitive member having the difference in the height of the concave and convex corresponding to 90% and 50% of the cumulative frequency of the height of the concave and convex within the range of 3 nm to 35 nm with the most deepest point of the surface roughness concave and convex within the range of 10 μm×10 μm as a standard was excellent both in the high-humidity smearing and sharpness of the digital image.

Also, the photosensitive member having the difference in the height of the concave and convex corresponding to 90% and 50% of the cumulative frequency of the height of the concave and convex within the range of 5 nm to 30 nm was extremely excellent both in the high-humidity smearing and separation stability. Also, since the interface was absent, an excellent region in the digital high-humidity smearing was expanded.

(Experiment 3)

Next, by using the electroconductive substrate where the microscopic surface roughness Ra measured by the AFM within the range of 10 μm×10 μm was changed, the electrophotographic photosensitive substrates No. 301 to 306 were manufactured. For the electroconductive substrate, a cylindrical substrate comprising Al having a purity equal to or more than 99.9% was used, and the film forming condition was adjusted so that the difference in the height of the concave and convex corresponding to 90% and 50% of the cumulative frequency of the surface roughness measured by the AMF becomes approximately 20 nm to 30 nm.

The microscopic surface roughness Ra of the electroconductive substrate of each photosensitive member of Nos. 301 to 306 and the result of the image estimation are shown in Table 3.

The image estimation was made by using the modified electrophotographic apparatus NP6350 made by CANON, wherein the passing-sheet endurance of 500,000 sheets was performed by using a test pattern of a 7% printing rate and a dot defect estimation was made. The dot defect is that in the film formation of the photosensitive layer, a part of the film abnormally grows and as a result a black point or a white point is infrequently but often produced on the printing image.

As reference symbols of Table 3, ◎ means "excellent (no problem)", ○ means "practically acceptable" and × "possibly posing practical problem".

From the result of Table 3, in the photosensitive member where the microscopic surface roughness Ra of the electroconductive substrate is smaller than 9 nm, preferably smaller than 6 nm, the dot defect was not produced, but an extremely excellent image was obtained.

(Experiment 4)

Next, by using the above described a-Si photosensitive member film forming apparatus and changing each parameter of the manufacturing conditions, the electrophotographic photosensitive members Nos. 401 to 406 where the photoconductive layer is made of a single layer and where the difference in the height of the concave and convex corresponding to 90% and 50% of the cumulative frequency of the surface roughness in the AFM measurement level and the surface roughness Rz in the surface roughness tester measurement level were changed, the photoconductive members Nos. 407 to 412 where the above described photoconductive layer is made of a plurality layers, the similar photosensitive member No. 413 except that the above described photoconductive layer is made of a plurality of layers and in absence of the interface, and the similar photosensitive member No. 414 except that the above described photoconductive layer is made of a plurality layers and in absence of the interface and the mosttop surface comprises a-C:H were manufactured.

For the electroconductive substrate, a cylindrical substrate comprising Al with a purity equal to or more than 99.9% was used, which was treated with a mirror processing by cutting and the microscopic surface roughness Ra was standardized less than 6 nm.

The difference in the height of the concave and convex corresponding to 90% and 50% of the cumulative frequency of the surface roughness measured by the AFM within the range of 10 μm×10 μm of each photosensitive member of Nos. 401 to 414, the surface roughness Rz measured by the contact type surface roughness tester and the results of the image estimation are shown in Table 4.

The image estimation was made by using the CANON electrophotographic apparatus NP6350 as it is, or the apparatus where the image exposure was modified to a LED array or a laser, wherein the passing-sheet endurance of 500,000 sheets was performed by using a test pattern of 3% printing rate lowered than the usual printing rate and the estimation of the high-humidity smearing and separation stability was made.

In the case of an analogue image, an original having a line width of 200 μm and an interval of 500 μm was copied and the estimation of a good or bad line width repeatability was made. In the case of a digital image, from concentration uniformity of a half-tone image comprising an isolated dot formation of 25% printing rate or a KEIMA pattern, the estimation of the high-humidity smearing was made.

Also, separation stability periodically outputted a white image and a black image and was estimated by the jam rate in the separation portion.

As reference symbols of Table 4, ◎ means "excellent (no problem)", ○ means "practically acceptable" and × means "possibly posing practical problem".

From the result of Table 4, the photosensitive member having the difference in the height of the concave and convex corresponding to 90% and 50% of the cumulative frequency of the height of concave and convex with respect to the most deepest point of the surface roughness concave and convex within the range of 10 μm×10 μm as a standard which was in the range of 3 nm to 35 nm was excellent both in the high-humidity smearing and separation stability.

Also, the photosensitive member having the difference in the height of the concave and convex corresponding to 90% and 50% of the cumulative frequency of the frequency distribution which was in the range of 5 nm to 30 nm was exceptionally excellent in either of the high-humidity smearing and separation stability. Also, since the interface was absent, an excellent region in the high-humidity smearing and separation stability was expanded.

(Experiment 5)

Next, by using the above described a-Si photosensitive member film deposition apparatus and changing the substrate shape and each parameter of the manufacturing conditions, the electrophotographic photosensitive member Nos. 501 to 513 where the difference in the height of the concave and convex corresponding to 90% and 50% of the cumulative frequency of the surface roughness in the AFM measurement level and the surface roughness Rz in the surface roughness tester measurement level were changed were manufactured. For the electroconductive substrate, a cylindrical substrate comprising Al was used, which was treated with various substrate surface processing such as a cutting processing, a dimple processing or the like.

Figure 10:
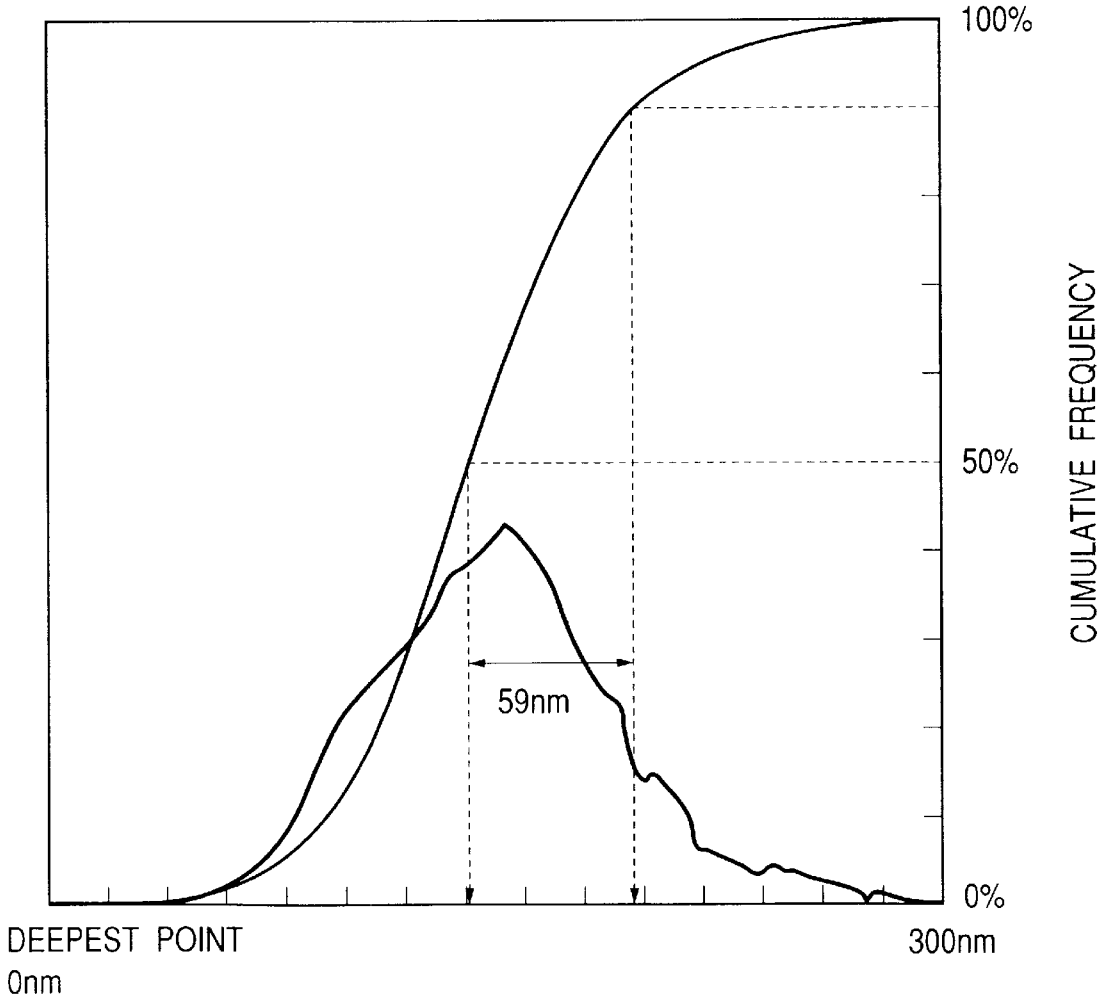

With respect to some of the above described photosensitive members, concretely, the difference in the height of the concave and convex corresponding to 90% and 50% of the cumulative frequency of the surface roughness where No. 504 was measured by the AFM within the range of 10 $\mu$m×10 $\mu$m is shown in FIG. 10. As is evident from this drawing, a width, a height and a balance of the left and the right of the frequency distribution allow characteristics to appear in the shape of the cumulative frequency. Further, the difference in the height of the concave and convex corresponding 90% and 50% of the cumulative frequency corresponds to the concave and convex of the mosttop surface portion and is considered to be a portion playing a large part in the characteristics such as the toner melted adherence prevention or the like.

The present invention, by aiming at the difference in the height of the concave and convex corresponding to 90% and 50% of the cumulative frequency, shows in Table 5 the difference in the height of the concave and convex corresponding to 90% and 50% of the cumulative frequency of the surface roughness measured by the AFM within the range of 10 $\mu$m×10 $\mu$m of each photosensitive member of Nos. 501 to 513, the surface roughness Rz measured by the contact type surface roughness tester, and the result of the estimation.

Here, the surface roughness of $\mu$m order points to a value of the surface roughness Rz measured in the estimation length of 1.25 mm by using the contact type surface roughness tester (Surf Coder SE-3400 manufactured by KOSAKA LABORATORY CORPORATION).

Figure 11:
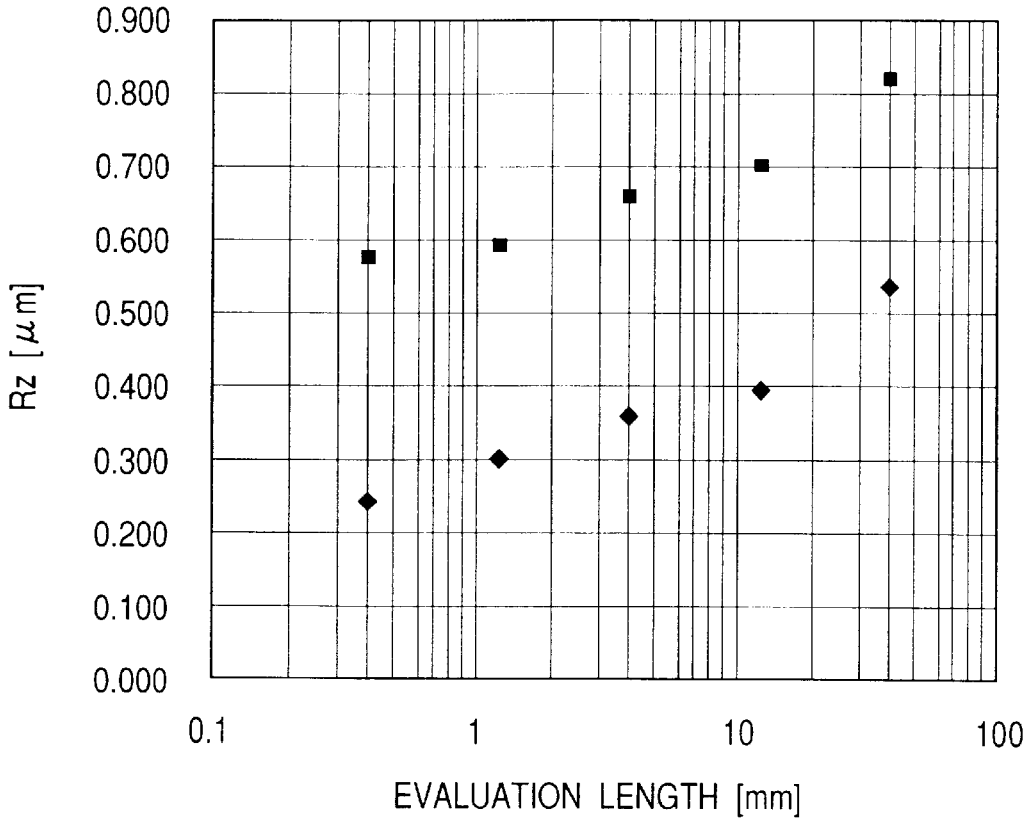

Note that, in the measurement by the above described surface roughness tester, the present inventors performed the measurement in several measurement lengths for several samples. A part of the result is shown in FIG. 11.

This drawing shows two samples having a relatively small roughness and a medium roughness of the films formed by changing the substrate and the manufacturing conditions in the estimation length and Rz (ten points average roughness) of the roughness index JIS-B0601 generally easy to image.

The estimation length and Rz are mutually related. That is, if the estimation length is not regulated, an accurate roughness cannot be specified and therefore the present invention specified the surface roughness Rz in the estimation length of 1.25 mm.

The image estimation was made by using the electrophotographic apparatus NP6350 made by CANON, wherein the passing-sheet endurance of 500,000 sheets was performed by using a test pattern of 3% printing rate lowered than the usual printing rate and a white image and a black image were periodically outputted and the estimation of the toner adherence was made.

As reference symbols of Table 5, ◎ means "excellent (no problem)", ○ means "practically acceptable" and × means "possibly posing practical problem".

From the result of Table 5, there was no mutual relation between the value of the conventional roughness Rz and the toner adherence. On the contrary, there was a mutual relation between a half value width of the roughness frequency distribution and the toner adherence.

(Experiment 6)

By using the above described a-Si photosensitive member film forming apparatus and changing each parameter of the manufacturing conditions, the electrophotographic photosensitive members Nos. 601 to 612 were manufactured, where the frequency distribution of the surface roughness in the AFM measurement level and the surface roughness Rz in the surface roughness tester measurement level were changed, and the similar photosensitive members Nos. 613 and 614 except that they are in absence of the interface were manufactured. As the electroconductive substrate, a cylindrical substrate comprising Al with a purity equal to or more than 99.9% was used, and the microscopic surface roughness treated with a mirror processing by cutting was standardized below 9 nm.

The difference in the height of the concave and convex corresponding to 90% and 50% of the cumulative frequency of the surface roughness measured by the AFM within the range of 10 $\mu$m×10 $\mu$m of each photosensitive member of Nos. 601 to 612, the surface roughness Rz measured by the contact type surface roughness tester, and the result of the image estimation are shown in Table 6.

The image estimation was made by using the CANON electrophotographic apparatus NP6350 as it is, or the apparatus where the image exposure was modified to a LED array or a laser, wherein the passing-sheet endurance of 500,000 sheets was performed by using a test pattern of 3% printing rate lowered than usual, and the toner adherence, the cleaning defect and the sharpness of a digital image were estimated.

The toner adherence and the cleaning defect were estimated by periodically outputting a white image and a black image, and the sharpness of the digital image was estimated by forming a pattern with a line width of 60 $\mu$m to 500 $\mu$m and a line interval of 60 $\mu$m to 500 $\mu$m, as a good or a bad repeatability thereof.

As reference symbols of Table 6, ◎ means "excellent (no problem)", ○ means "practically acceptable" and × means "possibly posing practical problem".

From the result of Table 6, the photosensitive member having the difference in the height of the concave and convex corresponding to 90% and 50% of the cumulative frequency of the height of the concave and convex with respect to the most deepest point of the surface roughness concave and convex within the range of 10 $\mu$m×10 $\mu$m as the standard which was in the range of 35 nm to 200 nm was excellent both in the toner adherence and the cleaning defect.

Also, the photosensitive member having the difference in the height of the concave and convex corresponding to 90% and 50% of the cumulative frequency which was in the range of 45 nm to 180 nm was exceptionally excellent in any of the toner adherence, the cleaning defect and the sharpness of the digital image. Also, since the interface was absent, a region excellent in the toner adherence or sharpness of the image was expanded.

(Experiment 7)

Next, by using the electroconductive substrate where the microscopic surface roughness Ra measured by the AFM within the range of 10 μm×10 μm was changed, the electrophotographic photosensitive members Nos. 701 to 706 were manufactured. As the electroconductive substrate, a cylindrical substrate comprising Al with a purity equal to or more than 99.9% was used, and the film forming condition was adjusted so that the difference in the height of the concave and convex corresponding to 90% and 50% of the cumulative frequency of the surface roughness measured by the AFM became 100 nm to 120 nm.

The microscopic surface roughness Rz of the electroconductive substrate of each photosensitive member of Nos. 701 to 706 and the result of the image estimation are shown in Table 7.

The image estimation was made by using the CANON electrophotographic apparatus NP6350 modified and the passing-sheet endurance of 500,000 sheets was performed by using a test pattern of a 7% printing rate and the estimation of a dot defect was made. The dot defect means that in the film formation of the photosensitive layer, the abnormal growth of a film is partially generated and as a result a black point or a white point is infrequently but often produced on the printing image.

As reference symbols of Table 7, ◎ means "excellent (no problem)", ○ means "practically acceptable" and × means "possibly posing practical problem".

From the result of Table 7, in the photosensitive member where the microscopic surface roughness Rz of the electroconductive substrate is below 9 nm, preferably below 6 nm, the dot defect was not generated, but an extremely excellent image was obtained.

(Experiment 8)

Next, by using the above described a-Si photosensitive member film forming apparatus and changing each parameter of the manufacturing conditions, the electrophotographic photosensitive members Nos. 801 to 806 where the photoconductive layer is made of a single layer and where the difference in the height of the concave and convex corresponding to 90% and 50% of the cumulative frequency of the surface roughness in the AFM measurement level and the surface roughness Rz in the surface roughness tester measurement level were changed, the electrophotographic photosensitive members Nos. 807, 812 where the above described photoconductive layer is made of a plurality of layers and the similar photosensitive members Nos. 813, 814 except that the above described photoconductive layer is made of a plurality of layers and in absence of the interface were manufactured. As the electroconductive substrate, a cylindrical substrate comprising Al with a purity equal to or more than 99.9% was used and treated with a mirror processing by cutting, and the microscopic surface roughness Rz was standardized less than 6 nm.

The difference in the height of the concave and convex corresponding to 90% and 50% of the cumulative frequency of the surface roughness measured by the AFM within the range of 10 μm×10 μm of each photosensitive member of Nos. 801 to 814, the surface roughness Rz measured by the contact type surface roughness tester and the results of the image estimation are shown in Table 8.

The image estimation was made by using the CANON electrophotographic apparatus NP6350 as it is, or the apparatus where the image exposure was modified to a LED array or a laser, wherein the passing-sheet endurance of 500,000 sheets was performed by using a test pattern of a 3% printing rate lowered than the usual rate, and the toner adherence, a cleaning defect and the sharpness of a digital image were estimated.

The toner adherence and the cleaning defect were estimated by periodically outputting a white image and a black image, and the sharpness of the digital image was estimated by forming a pattern with a line width of 60 μm to 500 μm and a line interval of 60 μm to 500 μm, as a good or a bad repeatability thereof.

As reference symbols of Table 8, ◎ means "excellent (no problem)", ○ means "practically acceptable" and × means "possibly posing practical problem".

From the result of Table 8, the photosensitive member having the difference in the height of the concave and convex corresponding to 90% and 50% of the cumulative frequency of the height of the concave and convex with respect to the most deepest point of the surface roughness concave and convex within the range of 10 μm×10 μm as a standard which was in the range of 35 nm to 200 nm was excellent both in the toner adherence and the cleaning defect.

Also, the photosensitive member having the difference in the height of the concave and convex corresponding to 90% and 50% of the cumulative frequency of the height of the concave and convex within the range of 35 nm to 200 nm, preferably 45 nm to 180 nm, was exceptionally excellent in any of the toner adherence, the cleaning defect and the sharpness of the digital image. Also, by not providing with the interface, a region excellent in the toner adherence or sharpness of the image was expanded.

Hereinafter, the present invention will be described based on examples and comparative examples.

EXAMPLES AND COMPARATIVE EXAMPLES A

By using the above described a-Si photosensitive member film forming apparatus and changing each parameter of the shape of a cylindrical substrate with a diameter of 80 mm and the manufacturing conditions, the difference in the height of the concave and convex corresponding to 90% and 50% of the cumulative frequency of the height of the concave and convex with respect to the most deepest point of the surface roughness concave and convex within the range of 10 μm×10 μm of the photosensitive member as a standard and the surface roughness Rz of μm order were changed to thereby manufacture plus charged electrophotographic photosensitive members (Examples A1 to A4, Comparative examples A1 to A3).

The difference in the height of the concave and convex corresponding to 90% and 50% of the cumulative frequency of the surface roughness within the range of 10 μm×10 μm of each photosensitive member of Examples A1 to A4 and Comparative examples A1 to A3, the microscopic surface roughness Ra of the electroconductive substrate and the results of the image estimation are shown in Table 9.

Figure 12:
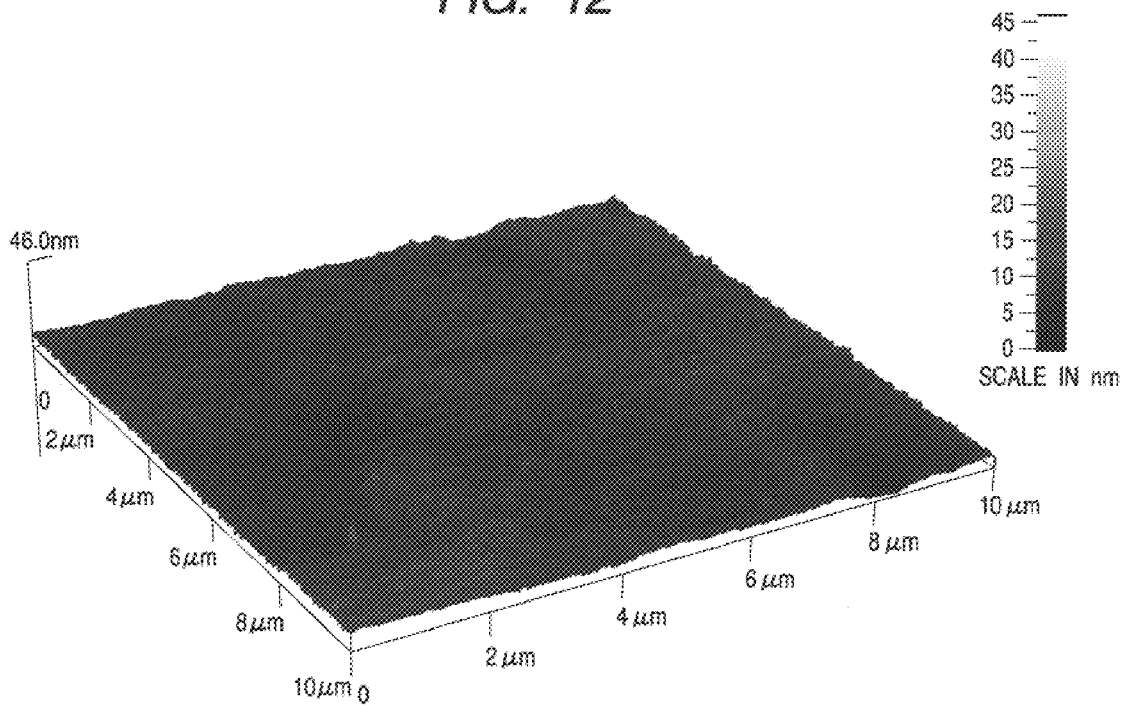
FIG. 12, FIG. 13, FIG. 14 and FIG. 15 are views respectively showing an example of the image observed by an atomic force microscope.
Figure 13:
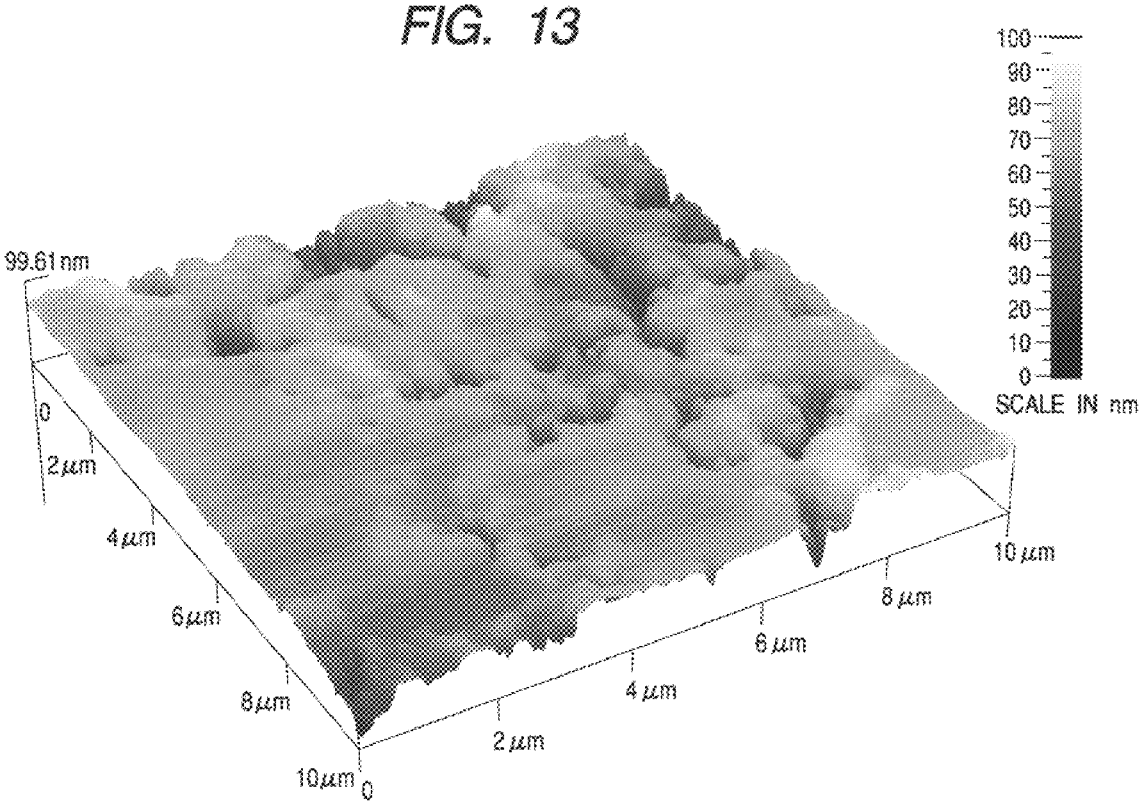

Also, an observed image example of the microscopic roughness measured by the AFM within the range of 10 μm×10 μm of the electroconductive substrate according to the present invention is shown in FIG. 12, and an observed image example of the microscopic roughness measured by the AFM within the range of 10 μm×10 μm of the photosensitive member surface according to the present invention is shown in FIG. 13.

The image estimation was made by using the CANON electrophotographic apparatus NP6350 which was converted to a digital exposure machine, wherein the passing-sheet endurance of 1,000,000 sheets was performed, the high-humidity smearing, separation stability and the dot defect were estimated, and from their results an overall estimation was made. Here, Example A2 and Comparative example A2 were estimated in the analogue image by using the CANON electrophotographic apparatus NP6350 modified.

As reference symbols of Table 9, ◎ means "excellent (no problem)", ○ means "practically acceptable" and × means "possibly posing practical problem".

Also, by using the above described a-Si photosensitive member film forming apparatus and changing each parameter of the substrate shape of a cylindrical substrate having a diameter of 30 mm and the manufacturing conditions, the difference in the height of the concave and convex corresponding to 90% and 50% of the cumulative frequency of the height of the concave and convex with respect to the most deepest point of the surface roughness concave and convex within the range of 10 μm×10 μm of the photosensitive member as a standard and the surface roughness Rz of μm order were changed to thereby manufacture minus charged electrophotographic photosensitive members (Example A5, Comparative example A4).

The difference in the height of the concave and convex corresponding to 90% and 50% of the cumulative frequency of the surface roughness within the range of 10 μm×10 μm of each photosensitive member of Example A5 and Ccomparative example A4, the microscopic surface roughness Ra of the electroconductive substrate and the results of the image estimation are shown in Table 10.

The image estimation was made by using the CANON electrophotographic apparatus GP405 modified, wherein the passing-sheet endurance of 300,000 sheets was performed, the high-humidity smearing, separation stability and the dot defect were estimated, and from their results an overall estimation was made.

As reference symbols of Table 10, ◎ means "excellent (no problem)", ○ means "practically acceptable" and × "possibly posing practical problem".

EXAMPLE AND COMPARATIVE EXAMPLE B

By using the above described a-Si photosensitive member film forming apparatus and changing each parameter of a cylindrical substrate shape with a diameter of 80 mm and the manufacturing conditions, the difference in the height of the concave and convex corresponding to 90% and 50% of the cumulative frequency of the height of the concave and convex with respect to the most deepest point of the surface roughness concave and convex within the range of 10 μm×10 μm of the photosensitive member as a standard and the surface roughness Rz of μm order were changed to thereby manufacture plus charged electrophotographic photosensitive members (Example B1 to B4, Comparative examples B1 to B3).

The difference in the height of the concave and convex corresponding to 90% and 50% of the cumulative frequency of the surface roughness within the range of 10 μm×10 μm of each photosensitive member of Examples B1 to B4 and Comparative examples B1 to B3, the microscopic surface roughness Ra of the electroconductive substrate and the results of the image estimation are shown in Table 11.

Figure 14:
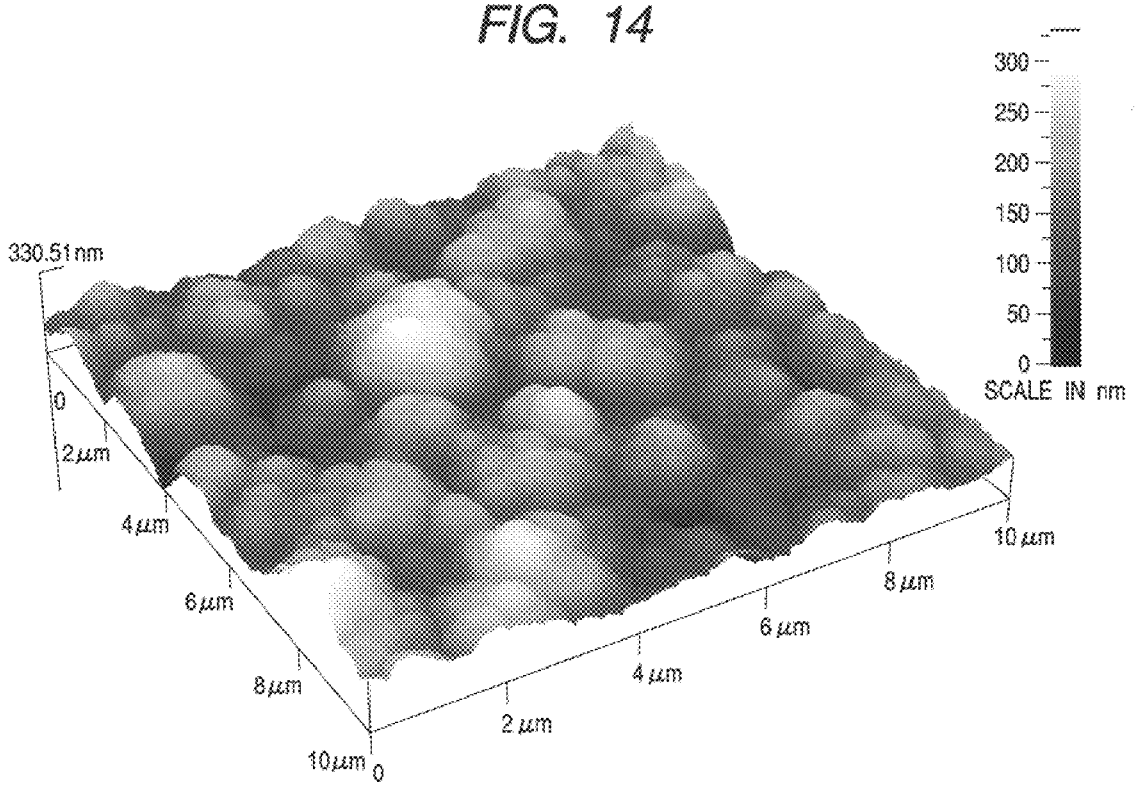
Figure 15:
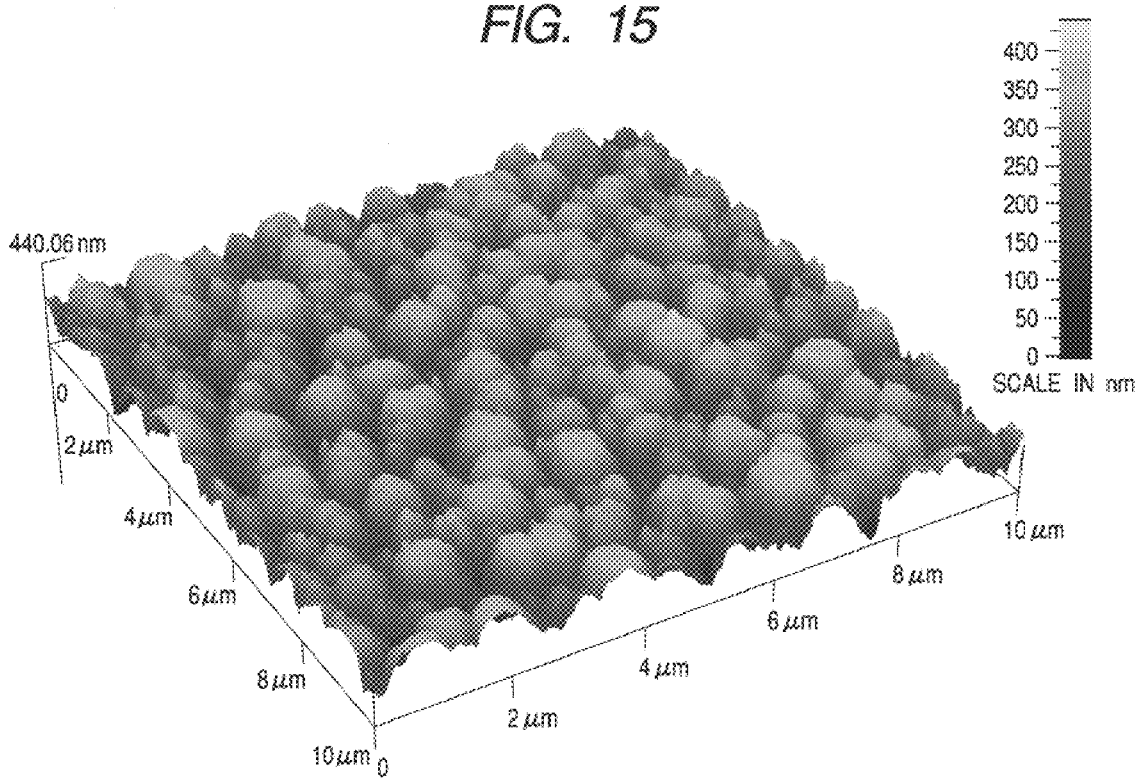
Figure 17A:
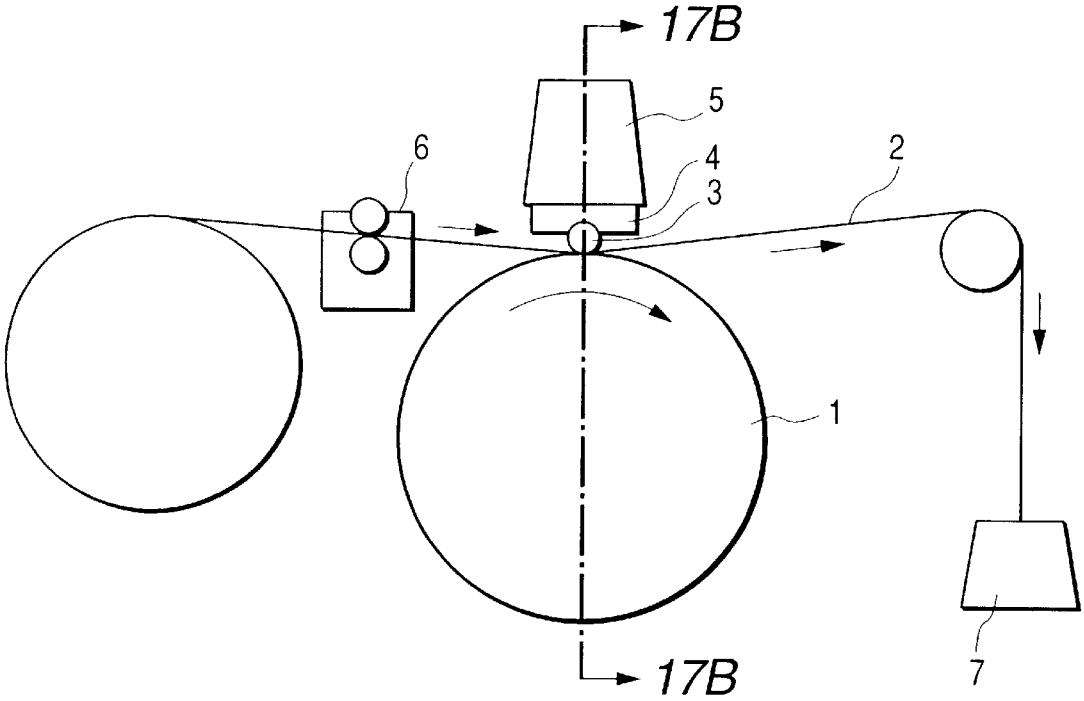
FIG. 17A is a schematic representation for showing the polishing apparatus for the surface of an electrophotographic photosensitive member.
Figure 17B:
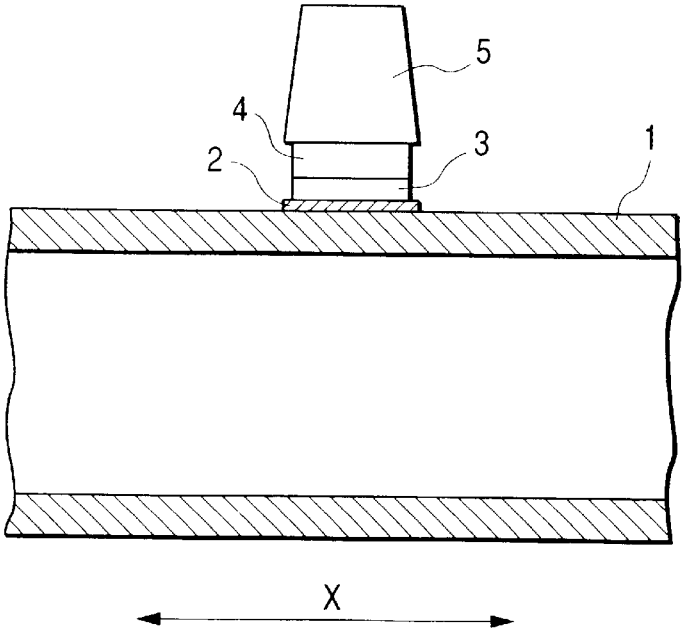
FIG. 17B is a sectional view taken in the line 17B—17B of FIG. 17A.

Also, an observed image example of the microscopic roughness measured by the AFM within the range of 10 μm×10 μm of the electroconductive substrate used in Example B1 is shown in FIG. 12, and observed image examples of the microscopic roughness measured by the AFM within the range of 10 μm×10 μm of the photosensitive member surface of the present invention are shown in FIG. 14 and FIG. 15.

The image estimation was made by using the CANON electrophotographic apparatus NP6350 which was modified to a digital exposure machine, wherein the passing-sheet endurance of 1,000,000 sheets was performed, the toner adherence, the cleaning defect and the sharpness of the digital image were estimated, and from their results an overall estimation was made. Here, Example B2 and Comparative example B2 were estimated in the analogue image by using the CANON electrophotographic apparatus NP6350 modified.

As reference symbols of Table 5, ◎ means "excellent (no problem)", ○ means "practically acceptable" and × means "possibly posing practical problem".

Also, by using the above described a-Si photosensitive member film forming apparatus and changing each parameter of a cylindrical substrate shape with a diameter of 30 mm and the manufacturing conditions, the difference in the height of the concave and convex corresponding to 90% and 50% of the cumulative frequency of the height of the concave and convex with respect to the most deepest point of the surface roughness concave and convex within the range of 10 μm×10 μm of the photosensitive member as a standard and the surface roughness Rz of μm order were changed to thereby manufacture minus charged electrophotographic photosensitive members (Example B5, Comparative example B4).

The difference in the height of the concave and convex corresponding to 90% and 50% of the cumulative frequency of the surface roughness within the range of 10 μm×10 μm of each photosensitive member of Example B5 and Comparative example B4, the microscopic surface roughness Ra of the electroconductive substrate and the results of the image estimation are shown in Table 12.

The image estimation was made by using the CANON electrophotographic apparatus GP405 modified, wherein the passing-sheet endurance of 300,000 sheets was performed, the toner adherence, the cleaning defect and sharpness of the digital image were estimated, and from their results an overall estimation was made.

As reference symbols of Table 6, ◎ means "excellent (no problem)", ○ means "practically acceptable" and × means "possibly posing practical problem".

As described above, according to the electrophotographic photosensitive member and the electrophotographic apparatus of the present invention, by allowing the difference in the height of the concave and convex corresponding to 90% and 50% of the cumulative frequency of the height of the concave and convex with respect to the most deepest point, as a standard, of the surface roughness concave and convex within the range of 10 μm×10 μm of the photosensitive member formed by stacking in order the photosensitive layer at least containing amorphous Si and the surface protective layer on the electroconductive substrate to be within 3 nm to 200 nm, preferably 3 nm to 35 nm or 35 nm to 200 nm, more preferably 5 nm to 30 nm or 45 nm to 180 nm, it became possible to prevent the high-humidity smearing, or to prevent the toner adherence and the dot defect at the time of cleaning, thereby enabling to form an excellent image.

Further, according to the electrophotographic photosensitive member and the electrophotographic apparatus of the present invention, by allowing the surface roughness Ra within the range of 10 μm×10 μm of the electroconductive substrate to be smaller than 9 nm, more preferably smaller than 6 nm and the difference in the height of the concave and convex corresponding to 90% and 50% of the cumulative frequency of the height of the concave and convex with respect to the most deepest point, as a standard, of the surface roughness concave and convex to be within 3 nm to 35 nm, more preferably 5 nm to 30 nm, it became specially possible to prevent the high-humidity smearing and the dot defect, thereby enabling to form an excellent image.

Further, according to the electrophotographic photosensitive member and the electrophotographic apparatus of the present invention, by allowing the surface roughness Ra within the range of 10 $\mu$m×10 $\mu$m of the electroconductive substrate to be smaller than 9 nm, more preferably smaller than 6 nm and the difference in the height of the concave and convex corresponding to 90% and 50% of the cumulative frequency of the height of the concave and convex with respect to the most deepest point, as a standard, of the surface roughness concave and convex to be within 35 nm to 200 nm, more preferably 45 nm to 180 nm, it became specially possible to prevent the toner adherence and the dot defect at the time of cleaning, thereby enabling to form an excellent image.

Also, in the above described, it became possible to continuously change the interface composition between the surface protective layer and the photosensitive layer of the photosensitive member, and also in the region where a spectral reflectance in the above described interface composition satisfies the following equation; $0 \leqq (Max-Min)/(Max+Min) \leqq 0.4$, wherein Min is the minimum value of a reflectance (%) of light having a wavelength of 450 nm to 650 nm, and Max is the maximum value of a reflectance (%) of the light, it became possible to more effectively control the high-humidity smearing.

Further, in the above described, by constituting the photoconductive layer of the photosensitive member by a plurality of layers, it became possible to more effectively control the high-humidity smearing, improve sharpness of the image or control the toner adherence.

TABLE 1

| | Difference in height of concave and convex corresponding to 90% and 50% of cumulative frequency of roughness [nm] | Surface roughness Rz [$\mu$m] | Estimation | |
|---|---|---|---|---|
| | | | High-humidity smearing | Separation stability |
| 101 | 29.0 | 0.21 | ◎ | ◎ |
| 102 | 17.2 | 0.01 | ◎ | ○ |
| 103 | 52 | 0.11 | x | ◎ |
| 104 | 33.2 | 0.12 | ○ | ◎ |
| 105 | 7.9 | 1.09 | ◎ | ◎ |
| 106 | 20.3 | 2.17 | ◎ | ◎ |
| 107 | 10.2 | 2.44 | ◎ | ◎ |
| 108 | 10.4 | 0.06 | ◎ | ○ |
| 109 | 68 | 0.55 | x | ◎ |
| 110 | 46 | 0.32 | x | ◎ |
| 111 | 36.8 | 3.24 | x | ◎ |
| 112 | 4.5 | 0.02 | ○ | ○ |
| 113 | 2.6 | 0.11 | ○ | x |
| Estimation equipment | AFM manufactured by Quesant Company | Contact type surface roughness tester manufactured by KOSAKA LABORATORY CO., LTD. | Estimated by NP6350 analog apparatus manufactured by CANON | |

TABLE 2

| | Difference in height of concave and convex corresponding to 90% and 50% of cumulative frequency of roughness [nm] | Macroscopic surface roughness Rz [$\mu$m] | Interface reflectance degree, value equation (1) | Estimation | | |
|---|---|---|---|---|---|---|
| | | | | High-humidity smearing | Separation stability | High-humidity smearing |
| 201 | 1.7 | 0.30 | 0.47 | ○ | ○ | ○ |
| 202 | 2.6 | 0.22 | 0.45 | ○ | ○ | ○ |
| 203 | 4.4 | 0.31 | 0.47 | ◎ | ◎ | ◎ |
| 204 | 5.2 | 0.35 | 0.42 | ◎ | ◎ | ◎ |
| 205 | 10.9 | 0.30 | 0.43 | ◎ | ◎ | ◎ |
| 206 | 19 | 0.22 | 0.47 | ◎ | ◎ | ◎ |
| 207 | 29.1 | 0.41 | 0.43 | ◎ | ◎ | ◎ |
| 208 | 34.6 | 0.21 | 0.47 | ○ | ◎ | ◎ |

TABLE 2-continued

| | Difference in height of concave and convex corresponding to 90% and 50% of cumulative frequency of roughness [nm] | Macroscopic surface roughness Rz [μm] | Interface reflectance degree, value equation (1) | Estimation | | |
|---|---|---|---|---|---|---|
| | | | | High-humidity smearing | Separation stability | High-humidity smearing |
| 209 | 38 | 0.23 | 0.50 | x | ⊙ | ○ |
| 210 | 54 | 0.25 | 0.45 | x | ⊙ | x |
| 211 | 67 | 0.28 | 0.43 | x | ⊙ | x |
| 212 | 91 | 0.32 | 0.46 | x | ⊙ | x |
| 213 | 31 | 0.19 | 0.29 | ⊙ | ⊙ | ⊙ |
| 214 | 33 | 0.28 | 0.38 | ⊙ | ⊙ | ⊙ |
| Estimation equipment | AFM manufactured by Quesant Company | Contact type surface roughness tester manufactured by KOSAKA LABORATORY CO., LTD. | MCPD-2000 manufactured by Ohtsuka Electron Company | Estimated by NP6350 digital modified apparatus manufactured by CANON | | No modification estimated by analog apparatus |

TABLE 3

| | Microscopic surface roughness of substrate [nm] | Image estimation Dot defect |
|---|---|---|
| 301 | 3.1 | ⊙ |
| 302 | 5.9 | ⊙ |
| 303 | 6.4 | ○ |
| 304 | 8.5 | ○ |
| 305 | 12.3 | x |
| 306 | 18.9 | x |
| Estimation equipment | AFM manufactured by Quesant Company | Estimated by NP6350 modified apparatus manufactured by CANON |

TABLE 4

| | Difference in height of concave and convex corresponding to 90% and 50% of cumulative frequency of roughness [nm] | Macroscopic surface roughness Rz [μm] | Estimation | | |
|---|---|---|---|---|---|
| | | | High-humidity smearing | Separation stability | High-humidity smearing |
| 401 | 4.8 | 0.20 | ⊙ | ○ | ⊙ |
| 402 | 9.3 | 0.19 | ⊙ | ⊙ | ⊙ |
| 403 | 18 | 0.21 | ⊙ | ⊙ | ⊙ |
| 404 | 34 | 0.20 | ○ | ⊙ | ○ |
| 405 | 46 | 0.30 | x | ⊙ | x |
| 406 | 53 | 0.27 | x | ⊙ | x |
| 407 | 4.4 | 0.19 | ⊙ | ○ | ⊙ |
| 408 | 9.8 | 0.19 | ⊙ | ⊙ | ⊙ |
| 409 | 19 | 0.32 | ⊙ | ⊙ | ⊙ |
| 410 | 34 | 0.29 | ⊙ | ⊙ | ⊙ |
| 411 | 45 | 0.28 | x | ⊙ | x |
| 412 | 53 | 0.31 | x | ⊙ | x |
| 413 | 32 | 0.21 | ⊙ | ⊙ | ⊙ |
| 414 | 35 | 0.21 | ⊙ | ⊙ | ⊙ |
| Estima- | AFM manufactured | Contact type | Estimated by | | No |

TABLE 4-continued

| | Difference in height of concave and convex corresponding to 90% and 50% of cumulative frequency of roughness [nm] | Macroscopic surface roughness Rz [μm] | Estimation | | |
|---|---|---|---|---|---|
| | | | High-humidity smearing | Separation stability | High-humidity smearing |
| tion equip-ment | by Quesant Company | surface roughness tester manufactured by KOSAKA LABORATO-RY CO., LTD. | NP6350 digital modified apparatus manufactured by CANON | | modification estimated by analog apparatus |

TABLE 5

| | Difference in height of concave and convex corresponding to 90% and 50% of cumulative frequency [nm] | Surface roughness Rz [μm] | Image estimation Toner adherence |
|---|---|---|---|
| 501 | 85 | 0.21 | ⊙ |
| 502 | 71 | 0.19 | ⊙ |
| 503 | 30.5 | 0.11 | x |
| 504 | 59 | 0.12 | ⊙ |
| 505 | 32.2 | 1.09 | x |
| 506 | 42.6 | 2.17 | ⊙ |
| 507 | 54 | 2.44 | ⊙ |
| 508 | 40.5 | 0.68 | ⊙ |
| 509 | 158 | 0.55 | ⊙ |
| 510 | 116 | 0.32 | ⊙ |
| 511 | 51 | 3.24 | ⊙ |
| 512 | 23.2 | 3.25 | ○ |
| 513 | 10.1 | 0.11 | x |
| Estimation equipment | AFM manufactured by Quesant Company | Contact type surface roughness tester manufactured by KOSAKA LABORATORY CO., LTD. | Estimated by NP6350 manufactured by CANON |

TABLE 6

| | Difference in height of concave and convex corresponding to 90% and 50% of cumulative frequency [nm] | Macroscopic surface roughness Rz [μm] | Image estimation | | |
|---|---|---|---|---|---|
| | | | Toner adherence | Cleaning defect | Sharpness of digital image |
| 601 | 28.1 | 0.20 | x | ○ | ⊙ |
| 602 | 28.6 | 0.19 | x | ○ | ⊙ |
| 603 | 38 | 0.19 | ⊙ | ○ | ⊙ |
| 604 | 42.8 | 0.20 | ⊙ | ⊙ | ⊙ |
| 605 | 45.2 | 0.20 | ⊙ | ⊙ | ⊙ |
| 606 | 69 | 0.22 | ⊙ | ⊙ | ⊙ |
| 607 | 84 | 0.21 | ⊙ | ⊙ | ⊙ |
| 608 | 125 | 0.21 | ⊙ | ⊙ | ⊙ |
| 609 | 179 | 0.23 | ⊙ | ⊙ | ⊙ |
| 610 | 198 | 0.25 | ⊙ | ○ | ○ |
| 611 | 217 | 0.28 | ⊙ | ○ | x |
| 612 | 241 | 0.32 | ⊙ | x | x |
| 613 | 35.2 | 0.19 | ⊙ | ⊙ | ⊙ |
| 614 | 216 | 0.28 | ⊙ | ○ | ○ |
| Estimation equipment | AFM manufactured by Quesant | Contact type surface roughness | Estimated by NP6350 modified apparatus manu- | | Modification estimated by digital |

TABLE 6-continued

| | Difference in height of concave and convex corresponding to 90% and 50% of cumulative frequency [nm] | Macroscopic surface roughness Rz [μm] | Image estimation | | |
|---|---|---|---|---|---|
| | | | Toner adherence | Cleaning defect | Sharpness of digital image |
| | Company | tester manufactured by KOSAKA LABORATOR Y CO., LTD. | factured by CANON | | apparatus |

TABLE 7

| | Microscopic surface roughness of substrate Ra[nm] | Image estimation Dot defect |
|---|---|---|
| 701 | 3.1 | ◎ |
| 702 | 5.9 | ◎ |
| 703 | 6.4 | ○ |
| 704 | 8.5 | ○ |
| 705 | 12.3 | x |
| 706 | 18.9 | x |
| Estimation equipment | AFM manufactured by Quesant Company | Estimated by NP6350 modified apparatus manufactured by CANON |

TABLE 8

| | Difference in height of concave and convex corresponding to 90% and 50% of cumulative frequency [nm] | Macroscopic surface roughness Rz [μm] | Interface reflectance degree, value of equation (1) | Image estimation | | |
|---|---|---|---|---|---|---|
| | | | | Toner adherence | Cleaning defect | Sharpness of digital image |
| 801 | 28.1 | 0.20 | 0.45 | x | ○ | ◎ |
| 802 | 36.2 | 0.19 | 0.47 | ◎ | ◎ | ◎ |
| 803 | 74 | 0.21 | 0.42 | ◎ | ◎ | ◎ |
| 804 | 142 | 0.20 | 0.43 | ◎ | ◎ | ◎ |
| 805 | 185 | 0.30 | 0.47 | ◎ | ◎ | ○ |
| 806 | 212 | 0.27 | 0.42 | ◎ | ○ | x |
| 807 | 27.6 | 0.19 | 0.45 | x | ◎ | ◎ |
| 808 | 38 | 0.19 | 0.47 | ◎ | ◎ | ◎ |
| 809 | 78.4 | 0.32 | 0.42 | ◎ | ◎ | ◎ |
| 810 | 149 | 0.29 | 0.43 | ◎ | ◎ | ◎ |
| 811 | 197 | 0.28 | 0.47 | ◎ | ◎ | ◎ |
| 812 | 240 | 0.31 | 0.50 | ◎ | x | x |
| 813 | 35.5 | 0.19 | 0.31 | ◎ | ◎ | ◎ |
| 814 | 206 | 0.28 | 0.38 | ◎ | ◎ | ◎ |
| Estimation equipment | AFM manufactured by Quesant Company | Contact type surface roughness tester manufactured by KOSAKA LABORATORY CO., LTD. | MCPD-2000 manufactured by Ohtsuka Electron Company | Estimated by NP6350 modified apparatus manufactured by CANON | | Modification estimated by digital apparatus |

TABLE 9

| | Difference in height of concave and convex corresponding to 90% and 50% of cumulative frequency of roughness [nm] | Microscopic surface roughness of substrate [μm] | Inter-face | Estimation: High-humidity smearing | Separation stability | Dot defect | Total estimation |
|---|---|---|---|---|---|---|---|
| Example A1 | 21.8 | 5.9 | With | ◎ | ◎ | ◎ | ◎ |
| Example A2 | 21.8 | 5.9 | With | ◎ | ◎ | ◎ | ◎ |
| Example A3 | 20.5 | 8.5 | With | ◎ | ◎ | ○ | ○ |
| Example A4 | 9.1 | 5.9 | Without | ◎ | ◎ | ◎ | ◎ |
| Comparative example A1 | 53 | 5.9 | With | x | ◎ | ◎ | x |
| Comparative example A2 | 53 | 5.9 | With | x | ◎ | ◎ | x |
| Comparative example A3 | 2.1 | 5.9 | With | ○ | x | ◎ | x |
| Estimation equipment | AFM manufactured by Quesant Company | | | Estimated by NP6350 modified apparatus manufactured by CANON | | | |

TABLE 10

| | Difference in height of concave and convex corresponding to 90% and 50% of cumulative frequency of roughness [nm] | Microscopic surface roughness of substrate [μm] | Inter-face | Estimation: High-humidity smearing | Separation stability | Dot defect | Total estimation |
|---|---|---|---|---|---|---|---|
| Example A5 | 16.1 | 5.5 | Without | ◎ | ◎ | ◎ | ◎ |
| Comparative example A4 | 55 | 5.5 | Without | x | ◎ | ◎ | x |
| Estimation equipment | AFM manufactured by Quesant Company | | | Estimated by NP6350 modified apparatus manufactured by CANON | | | |

TABLE 11

| | Difference in height of concave and convex corresponding to 90% and 50% of cumulative frequency of roughness [nm] | Micro-scopic surface roughness of substrate [μm] | Inter-face | Image estimation: Toner adherence | Cleaning defect | Dot defect | Sharp-ness of digital image | Total estima-tion |
|---|---|---|---|---|---|---|---|---|
| Example B1 | 84 | 5.9 | With | ◎ | ◎ | ◎ | ◎ | ◎ |
| Example B2 | 84 | 5.9 | With | ◎ | ◎ | ◎ | — | ◎ |
| Example B3 | 83 | 8.5 | With | ◎ | ◎ | ○ | ◎ | ○ |
| Example B4 | 37.5 | 5.9 | Without | ◎ | ◎ | ◎ | ◎ | ◎ |
| Comparative example B1 | 32.2 | 5.9 | With | x | ○ | ◎ | ◎ | x |
| Comparative example B2 | 32.2 | 5.9 | With | x | ○ | ◎ | — | x |
| Comparative example B3 | 217 | 5.9 | With | ○ | ○ | ◎ | x | x |

TABLE 11-continued

| | Difference in height of concave and convex corresponding to 90% and 50% of cumulative frequency of roughness [nm] | Microscopic surface roughness of substrate [μm] | Interface | Image estimation | | | | |
|---|---|---|---|---|---|---|---|---|
| | | | | Toner adherence | Cleaning defect | Dot defect | Sharpness of digital image | Total estimation |
| Estimation equipment | AFM manufactured by Quesant Company | | | Estimated by NP6350 modified apparatus manufactured by CANON | | | | |

TABLE 12

| | Difference in height of concave and convex corresponding to 90% and 50% of cumulative frequency of roughness [nm] | Microscopic surface roughness of substrate [μm] | Interface | Image estimation | | | | |
|---|---|---|---|---|---|---|---|---|
| | | | | Toner adherence | Cleaning defect | Dot defect | Sharpness of digital image | Total estimation |
| Example B5 | 84 | 5.5 | Without | ◎ | ◎ | ◎ | ◎ | ◎ |
| Comparative example B4 | 31.5 | 5.5 | Without | x | ◎ | ◎ | ◎ | x |
| Estimation equipment | AFM manufactured by Quesant Company | | | Estimated by GP405 modified apparatus manufactured by CANON | | | | |

What is claimed is:

1. An electrophotographic photosensitive member comprising a photoconductive layer containing at least amorphous Si and a surface protective layer which are stacked in order on an electroconductive substrate, wherein a difference in a height of concave and convex corresponding to 90% and 50% of cumulative frequency of a height of concave and convex with respect to a most deepest point of surface roughness concave and convex within a range of 10 μm×10 μm of the photosensitive member as a standard is within a range of 3 nm to 200 nm.

2. The electrophotographic photosensitive member according to claim 1, wherein the difference in the height of the concave and convex is within a range of 3 nm to 35 nm.

3. The electrophotographic photosensitive member according to claim 1, wherein the difference in the height of the concave and convex is within a range of 5 nm to 30 nm.

4. The electrophotographic photosensitive member according to claim 1, wherein the difference in the height of the concave and convex is within a range of 35 nm to 200 nm.

5. The electrophotographic photosensitive member according to claim 1, where the difference in the height of the concave and convex is within a range of 45 nm to 180 nm.

6. The electrophotographic photosensitive member according to claim 1, wherein the photoconductive layer is composed of a plurality of layers.

7. The electrophotographic photosensitive member according to claim 1, wherein in the photosensitive member the surface roughness Ra within the range of 10 μm×10 μm of the electroconductive substrate is smaller than 9 nm.

8. The electrophotographic photosensitive member according to claim 7, wherein in the photosensitive member the surface roughness Ra within the range of 10 μm×10 μm of the electroconductive substrate is smaller than 6 nm.

9. The electrophotographic photosensitive member according to claim 1, wherein a surface of the surface protective layer of the photosensitive member opposite to the electroconductive substrate is composed of hydrogenated amorphous silicon.

10. The electrophotographic photosensitive member according to claim 1, wherein an interface composition toward the photosensitive layer to the surface protective layer of the photosensitive member continuously changes so as to become a composition of the photosensitive layer from a composition of the surface protective layer.

11. The electrophotographic photosensitive member according to claim 10, wherein a spectral reflectance of light having a wavelength of 450 nm to 650 nm in an interface composition satisfies the following equation:

$$0 \leqq (\mathrm{Max}-\mathrm{Min})/(\mathrm{Max}+\mathrm{Min}) \leqq 0.4$$

where Min is a minimum value of a reflectance (%) of the light, and Max is a maximum value of a reflectance (%) of the light.

12. An image forming apparatus comprising:

an electrophotographic photosensitive member comprising a photoconductive layer containing at least amorphous Si and a surface protective layer which are stacked in order on an electroconductive substrate, wherein a difference in a height of concave and convex corresponding to 90% and 50% of cumulative frequency of a height of concave and convex with respect to a most deepest point of surface roughness concave and convex within a range of 10 $\mu$m×10 $\mu$m of the photosensitive member as a standard is within a range of 3 nm to 200 nm;

a charging means for the photosensitive member;

an exposing means for forming an electrostatic image; and a developing means for visualizing the electrostatic image.

13. The image forming apparatus according to claim 12, wherein the exposing means is provided with a light source mainly comprising a single wavelength.

* * * * *

UNITED STATES PATENT AND TRADEMARK OFFICE

CERTIFICATE OF CORRECTION

PATENT NO. : 6,534,228 B2 
DATED : March 18, 2003
INVENTOR(S) : Masaya Kawada et al.

It is certified that error appears in the above-identified patent and that said Letters Patent is hereby corrected as shown below:

Column 1,
Line 7, “prevent” should read -- present --.

Column 2,
Line 43, “the from” should read -- the --.

Column 12,
Line 1, “such” should read -- such as --.

Column 14,
Line 29, “lowered” should read -- lower --.

Column 16,
Line 42, “lowered” should read -- lower --.

Column 18,
Line 39, “lowered” should read -- lower --.

Column 24,
Tables 1 and 2, should read --

TABLE 1

| | Difference in height of concave and convex corresponding to 90% and 50% of cumulative frequency of roughness [nm] | Surface roughness Rz [μm] | Estimation: High-humidity smearing | Estimation: Separation stability |
|---|---|---|---|---|
| 101 | 29.0 | 0.21 | ⊙ | ⊙ |
| 102 | 17.2 | 0.01 | ⊙ | ○ |
| 103 | 52 | 0.11 | x | ⊙ |
| 104 | 33.2 | 0.12 | ○ | ⊙ |
| 105 | 7.9 | 1.09 | ⊙ | ⊙ |
| 106 | 20.3 | 2.17 | ⊙ | ⊙ |
| 107 | 10.2 | 2.44 | ⊙ | ⊙ |
| 108 | 10.4 | 0.06 | ⊙ | ○ |
| 109 | 68 | 0.55 | x | ⊙ |
| 110 | 46 | 0.32 | x | ⊙ |
| 111 | 36.8 | 3.24 | x | ⊙ |
| 112 | 4.5 | 0.02 | ○ | ○ |
| 113 | 2.6 | 0.11 | ○ | x |
| Estimation equipment | AFM manufactured by Quesant Company | Contact type surface roughness tester manufactured by KOSAKA LABORATORY CO., LTD. | Estimated by NP6350 analog apparatus manufactured by CANON | |

TABLE 2

| | Difference in height of concave and convex corresponding to 90% and 50% of cumulative frequency of roughness [nm] | Macroscopic surface roughness Rz [μm] | Interface reflectance degree, value equation (1) | Estimation: High-humidity smearing | Estimation: Separation stability | Estimation: High-humidity smearing |
|---|---|---|---|---|---|---|
| 201 | 1.7 | 0.30 | 0.47 | ○ | ○ | ○ |
| 202 | 2.6 | 0.22 | 0.45 | ○ | ○ | ○ |
| 203 | 4.4 | 0.31 | 0.47 | ⊙ | ⊙ | ⊙ |
| 204 | 5.2 | 0.35 | 0.42 | ⊙ | ⊙ | ⊙ |
| 205 | 10.9 | 0.30 | 0.43 | ⊙ | ⊙ | ⊙ |
| 206 | 19 | 0.22 | 0.47 | ⊙ | ⊙ | ⊙ |
| 207 | 29.1 | 0.41 | 0.43 | ⊙ | ⊙ | ⊙ |
| 208 | 34.6 | 0.21 | 0.47 | ○ | ⊙ | ⊙ |

--.

UNITED STATES PATENT AND TRADEMARK OFFICE

CERTIFICATE OF CORRECTION

PATENT NO. : 6,534,228 B2
DATED : March 18, 2003
INVENTOR(S) : Masaya Kawada et al.

It is certified that error appears in the above-identified patent and that said Letters Patent is hereby corrected as shown below:

Column 25,
Table 2-continued, Table 3 and Table 4 should read

--

TABLE 2-continued

| | Difference in height of concave and convex corresponding to 90% and 50% of cumulative frequency of roughness [nm] | Macroscopic surface roughness Rz [μm] | Interface reflectance degree, value equation (1) | Estimation: High-humidity smearing | Estimation: Separation stability | Estimation: High-humidity smearing |
|---|---|---|---|---|---|---|
| 209 | 38 | 0.23 | 0.50 | x | ◎ | o |
| 210 | 54 | 0.25 | 0.45 | x | ○ | x |
| 211 | 67 | 0.28 | 0.43 | x | ◎ | x |
| 212 | 91 | 0.32 | 0.46 | x | ○ | x |
| 213 | 31 | 0.19 | 0.29 | ◎ | ◎ | ◎ |
| 214 | 33 | 0.28 | 0.38 | ○ | ◎ | ◎ |
| Estimation equipment | AFM manufactured by Quesant Company | Contact type surface roughness tester manufactured by KOSAKA LABORATORY CO., LTD. | MCPD-2000 manufactured by Ohtsuka Electron Company | Estimated by NP6350 digital modified apparatus manufactured by CANON | | No modification estimated by analog apparatus |

TABLE 3

| | Microscopic surface roughness of substrate [nm] | Image estimation Dot defect |
|---|---|---|
| 301 | 3.1 | ◎ |
| 302 | 5.9 | ○ |
| 303 | 6.4 | o |
| 304 | 8.5 | o |
| 305 | 12.3 | x |
| 306 | 18.9 | x |
| Estimation equipment | AFM manufactured by Quesant Company | Estimated by NP6350 modified apparatus manufactured by CANON |

TABLE 4

| | Difference in height of concave and convex corresponding to 90% and 50% of cumulative frequency of roughness [nm] | Macroscopic surface roughness Rz [μm] | Estimation: High-humidity smearing | Estimation: Separation stability | Estimation: High-humidity smearing |
|---|---|---|---|---|---|
| 401 | 4.8 | 0.20 | ○ | o | ◎ |
| 402 | 9.3 | 0.19 | ○ | ◎ | ◎ |
| 403 | 18 | 0.21 | ◎ | ◎ | ◎ |
| 404 | 34 | 0.20 | o | ◎ | o |
| 405 | 46 | 0.30 | x | ◎ | x |
| 406 | 53 | 0.27 | x | ◎ | x |
| 407 | 4.4 | 0.19 | ◎ | o | ○ |
| 408 | 9.8 | 0.19 | ○ | ○ | ○ |
| 409 | 19 | 0.32 | ○ | ○ | ○ |
| 410 | 34 | 0.29 | ○ | ◎ | ○ |
| 411 | 45 | 0.28 | x | ◎ | x |
| 412 | 53 | 0.31 | x | ○ | x |
| 413 | 32 | 0.21 | ○ | ◎ | ◎ |
| 414 | 35 | 0.21 | ◎ | ◎ | ◎ |
| Estima- | AFM manufactured | Contact type | Estimated by | | No |

--.

CERTIFICATE OF CORRECTION

PATENT NO. : 6,534,228 B2
DATED : March 18, 2003
INVENTOR(S) : Masaya Kawada et al.

It is certified that error appears in the above-identified patent and that said Letters Patent is hereby corrected as shown below:

Column 27,
Table 4-continued, Table 5 and Table 6 should read

--

TABLE 4-continued

| | Difference in height of concave and convex corresponding to 90% and 50% of cumulative frequency of roughness [nm] | Macroscopic surface roughness Rz [μm] | Estimation | | |
|---|---|---|---|---|---|
| | | | High-humidity smearing | Separation stability | High-humidity smearing |
| tion equip-ment | by Quesant Company | surface roughness tester manufactured by KOSAKA LABORATO-RY CO., LTD. | NP6350 digital modified apparatus manufactured by CANON | | modification estimated by analog apparatus |

TABLE 5

| | Difference in height of concave and convex corresponding to 90% and 50% of cumulative frequency [nm] | Surface roughness Rz [μm] | Image estimation Toner adherence |
|---|---|---|---|
| 501 | 85 | 0.21 | ◎ |
| 502 | 71 | 0.19 | ◎ |
| 503 | 30.5 | 0.11 | x |
| 504 | 59 | 0.12 | ◎ |
| 505 | 32.2 | 1.09 | x |
| 506 | 42.6 | 2.17 | ◎ |
| 507 | 54 | 2.44 | ◎ |
| 508 | 40.5 | 0.68 | ◎ |
| 509 | 158 | 0.55 | ◎ |
| 510 | 116 | 0.32 | ◎ |
| 511 | 51 | 3.24 | ◎ |
| 512 | 23.2 | 3.25 | o |
| 513 | 10.1 | 0.11 | x |
| Estimation equipment | AFM manufactured by Quesant Company | Contact type surface roughness tester manufactured by KOSAKA LABORATORY CO., LTD. | Estimated by NP6350 manufactured by CANON |

TABLE 6

| | Difference in height of concave and convex corresponding to 90% and 50% of cumulative frequency [nm] | Macroscopic surface roughness Rz [μm] | Image estimation | | |
|---|---|---|---|---|---|
| | | | Toner adherence | Cleaning defect | Sharpness of digital image |
| 601 | 28.1 | 0.20 | x | o | ◎ |
| 602 | 28.6 | 0.19 | x | o | ◎ |
| 603 | 38 | 0.19 | ◎ | o | ◎ |
| 604 | 42.8 | 0.20 | ◎ | ◎ | ◎ |
| 605 | 45.2 | 0.20 | ◎ | ◎ | ◎ |
| 606 | 69 | 0.22 | ◎ | ◎ | ◎ |
| 607 | 84 | 0.21 | ◎ | ◎ | ◎ |
| 608 | 125 | 0.21 | ◎ | ◎ | ◎ |
| 609 | 179 | 0.23 | ◎ | ◎ | ◎ |
| 610 | 198 | 0.25 | o | o | o |
| 611 | 217 | 0.28 | ◎ | o | x |
| 612 | 241 | 0.32 | ◎ | x | x |
| 613 | 35.2 | 0.19 | ◎ | ◎ | ◎ |
| 614 | 216 | 028 | ◎ | o | o |
| Estimation equipment | AFM manufactured by Quesant | Contact type surface roughness | Estimated by NP6350 modified apparatus manu- | | Modification estimated by digital |

--.

CERTIFICATE OF CORRECTION

PATENT NO. : 6,534,228 B2
DATED : March 18, 2003
INVENTOR(S) : Masaya Kawada et al.

It is certified that error appears in the above-identified patent and that said Letters Patent is hereby corrected as shown below:

Column 29,
Table 6-continued, Table 7 and Table 8 should read

--

TABLE 6-continued

| | Difference in height of concave and convex corresponding to 90% and 50% of cumulative frequency [nm] | Macroscopic surface roughness Rz [μm] | Image estimation | | |
|---|---|---|---|---|---|
| | | | Toner adherence | Cleaning defect | Sharpness of digital image |
| | Company | tester manufactured by KOSAKA LABORATORY CO., LTD. | factured by CANON | | apparatus |

TABLE 7

| | Microscopic surface roughness of substrate Ra[nm] | Image estimation Dot defect |
|---|---|---|
| 701 | 3.1 | ◎ |
| 702 | 5.9 | ◎ |
| 703 | 6.4 | ○ |
| 704 | 8.5 | ○ |
| 705 | 12.3 | x |
| 706 | 18.9 | x |
| Estimation equipment | AFM manufactured by Quesant Company | Estimated by NP6350 modified apparatus manufactured by CANON |

TABLE 8

| | Difference in height of concave and convex corresponding to 90% and 50% of cumulative frequency [nm] | Macroscopic surface roughness Rz [μm] | Interface reflectance degree, value of equation (1) | Image estimation | | |
|---|---|---|---|---|---|---|
| | | | | Toner adherence | Cleaning defect | Sharpness of digital image |
| 801 | 28.1 | 0.20 | 0.45 | x | ○ | ◎ |
| 802 | 36.2 | 0.19 | 0.47 | ◎ | ◎ | ◎ |
| 803 | 74 | 0.21 | 0.42 | ◎ | ◎ | ◎ |
| 804 | 142 | 0.20 | 0.43 | ◎ | ◎ | ◎ |
| 805 | 185 | 0.30 | 0.47 | ◎ | ◎ | ○ |
| 806 | 212 | 0.27 | 0.42 | ◎ | ○ | x |
| 807 | 27.6 | 0.19 | 0.45 | x | ◎ | ◎ |
| 808 | 38 | 0.19 | 0.47 | ◎ | ◎ | ◎ |
| 809 | 78.4 | 0.32 | 0.42 | ◎ | ◎ | ◎ |
| 810 | 149 | 0.29 | 0.43 | ◎ | ◎ | ◎ |
| 811 | 197 | 0.28 | 0.47 | ◎ | ◎ | ◎ |
| 812 | 240 | 0.31 | 0.50 | ◎ | x | x |
| 813 | 35.5 | 0.19 | 0.31 | ◎ | ◎ | ◎ |
| 814 | 206 | 0.28 | 0.38 | ◎ | ◎ | ◎ |
| Estimation equipment | AFM manufactured by Quesant Company | Contact type surface roughness tester manufactured by KOSAKA LABORATORY CO., LTD. | MCPD-2000 manufactured by Ohtsuka Electron Company | Estimated by NP6350 modified apparatus manufactured by CANON | | Modification estimated by digital apparatus |

--.

CERTIFICATE OF CORRECTION

PATENT NO. : 6,534,228 B2
DATED : March 18, 2003
INVENTOR(S) : Masaya Kawada et al.

It is certified that error appears in the above-identified patent and that said Letters Patent is hereby corrected as shown below:

Column 31,
Tables 9, 10 and 11, should read

--

TABLE 9

| | Difference in height of concave and convex corresponding to 90% and 50% of cumulative frequency of roughness [nm] | Microscopic surface roughness of substrate [μm] | Inter-face | Estimation: High-humidity smearing | Separation stability | Dot defect | Total estimation |
|---|---|---|---|---|---|---|---|
| Example A1 | 21.8 | 5.9 | With | ◎ | ◎ | ◎ | ◎ |
| Example A2 | 21.8 | 5.9 | With | ◎ | ◎ | ◎ | ◎ |
| Example A3 | 20.5 | 8.5 | With | ◎ | ◎ | ○ | ○ |
| Example A4 | 9.1 | 5.9 | Without | ◎ | ◎ | ◎ | ◎ |
| Comparative example A1 | 53 | 5.9 | With | x | ◎ | ◎ | x |
| Comparative example A2 | 53 | 5.9 | With | x | ◎ | ◎ | x |
| Comparative example A3 | 2.1 | 5.9 | With | ○ | x | ◎ | x |
| Estimation equipment | AFM manufactured by Quesant Company | | | Estimated by NP6350 modified apparatus manufactured by CANON | | | |

TABLE 10

| | Difference in height of concave and convex corresponding to 90% and 50% of cumulative frequency of roughness [nm] | Microscopic surface roughness of substrate [μm] | Inter-face | Estimation: High-humidity smearing | Separation stability | Dot defect | Total estimation |
|---|---|---|---|---|---|---|---|
| Example A5 | 16.1 | 5.5 | Without | ◎ | ◎ | ◎ | ◎ |
| Comparative example A4 | 55 | 5.5 | Without | x | ◎ | ◎ | x |
| Estimation equipment | AFM manufactured by Quesant Company | | | Estimated by NP6350 modified apparatus manufactured by CANON | | | |

TABLE 11

| | Difference in height of concave and convex corresponding to 90% and 50% of cumulative frequency of roughness [nm] | Micro-scopic surface roughness of substrate [μm] | Inter-face | Image estimation: Toner adherence | Cleaning defect | Dot defect | Sharp-ness of digital image | Total estima-tion |
|---|---|---|---|---|---|---|---|---|
| Example B1 | 84 | 5.9 | With | ◎ | ◎ | ◎ | ◎ | ◎ |
| Example B2 | 84 | 5.9 | With | ◎ | ◎ | ◎ | — | ◎ |
| Example B3 | 83 | 8.5 | With | ◎ | ◎ | ○ | ◎ | ○ |
| Example B4 | 37.5 | 5.9 | Without | ◎ | ◎ | ◎ | ◎ | ◎ |
| Comparative example B1 | 32.2 | 5.9 | With | x | ○ | ◎ | ◎ | x |
| Comparative example B2 | 32.2 | 5.9 | With | x | ○ | ◎ | — | x |
| Comparative | 217 | 5.9 | With | ○ | ○ | ◎ | x | x |

--.

UNITED STATES PATENT AND TRADEMARK OFFICE

CERTIFICATE OF CORRECTION

PATENT NO. : 6,534,228 B2
DATED : March 18, 2003
INVENTOR(S) : Masaya Kawada et al.

It is certified that error appears in the above-identified patent and that said Letters Patent is hereby corrected as shown below:

Column 33,
Lines 1-36, Table 11-continued and Table 12 should read

--

TABLE 11-continued

| | Difference in height of concave and convex correspond-ing to 90% and 50% of cumulative frequency of roughness [nm] | Micro-scopic surface roughness of substrate [μm] | Inter-face | Image estimation: Toner adherence | Cleaning defect | Dot defect | Sharp-ness of digital image | Total estima-tion |
|---|---|---|---|---|---|---|---|---|
| example B3 | | | | | | | | |
| Estimation equipment | AFM manufactured by Quesant Company | | | Estimated by NP6350 modified apparatus manufactured by CANON | | | | |

TABLE 12

| | Difference in height of concave and convex correspond-ing to 90% and 50% of cumulative frequency of roughness [nm] | Micro-scopic surface roughness of substrate [μm] | Inter-face | Image estimation: Toner adherence | Cleaning defect | Dot defect | Sharp-ness of digital image | Total estima-tion |
|---|---|---|---|---|---|---|---|---|
| Example B5 | 84 | 5.5 | Without | ⊙ | ⊙ | ⊙ | ⊙ | ⊙ |
| Comparative example B4 | 31.5 | 5.5 | Without | x | ⊙ | ⊙ | ⊙ | x |
| Estimation equipment | AFM manufactured by Quesant Company | | | Estimated by GP405 modified apparatus manufactured by CANON | | | | |

--.

Signed and Sealed this

Twenty-third Day of December, 2003

JAMES E. ROGAN
*Director of the United States Patent and Trademark Office*